US009314061B2

(12) United States Patent
Hanson et al.

(10) Patent No.: US 9,314,061 B2
(45) Date of Patent: Apr. 19, 2016

(54) PROTECTIVE HELMET CAP

(71) Applicant: Guardian Innovations, LLC, Johns Creek, GA (US)

(72) Inventors: Erin Linn Hanson, Johns Creek, GA (US); Wallace Lee Hanson, Jr., Johns Creek, GA (US)

(73) Assignee: Guardian Innovations, LLC, Johns Creek, GA (US)

( * ) Notice: Subject to any disclaimer, the term of this patent is extended or adjusted under 35 U.S.C. 154(b) by 0 days.

(21) Appl. No.: 14/086,037

(22) Filed: Nov. 21, 2013

(65) Prior Publication Data

US 2014/0075652 A1 Mar. 20, 2014

Related U.S. Application Data

(63) Continuation-in-part of application No. 13/738,542, filed on Jan. 10, 2013.

(60) Provisional application No. 61/585,073, filed on Jan. 10, 2012.

(51) Int. Cl.

| | |
|---|---|
| ***A42B 3/00*** | (2006.01) |
| ***A42B 3/06*** | (2006.01) |
| ***A42B 3/12*** | (2006.01) |

(52) U.S. Cl.

CPC ..... *A42B 3/003* (2013.01); *A42B 3/069* (2013.01); *A42B 3/127* (2013.01); *A42B 3/00* (2013.01)

(58) Field of Classification Search

CPC ..... A42B 3/00; A42B 3/122; A42B 3/08; A42B 1/18; A42B 1/203; A42B 3/003; A42B 3/062; A42B 3/063; A42B 3/064; A42B 3/069; A42C 5/00

USPC ..... 2/411, 413, 421, 425, 175.3, 175.6, 2/DIG. 10; 602/17

See application file for complete search history.

(56) References Cited

U.S. PATENT DOCUMENTS

| | | | | | |
|---|---|---|---|---|---|
| 531,505 | A | * | 12/1894 | Brown | 441/124 |
| 1,251,537 | A | * | 1/1918 | Kempny | 2/6.8 |
| 1,560,073 | A | * | 11/1925 | Bontempi et al. | 2/171.02 |
| 1,841,232 | A | | 1/1932 | Wells | |
| 2,121,702 | A | * | 6/1938 | Larkin | 2/413 |
| 2,143,483 | A | * | 1/1939 | Iglauer | 2/411 |

(Continued)

OTHER PUBLICATIONS

Daniel, "Head Acceleration Measurements in Helmet-Helmet Impacts and the Youth Population", MS Thesis, Virginia Polytechnic Institute and State University, Apr. 16, 2012, 50 pages.

(Continued)

*Primary Examiner* — Khaled Annis
(74) *Attorney, Agent, or Firm* — Baker Hostetler LLP

(57) ABSTRACT

The present disclosure provides an apparatus for use in reducing the impact to the head during sporting activities. The present disclosure provides a helmet cap that covers an underlying hard shell helmet. The helmet cap has a durable, energy absorbing outer shell, which lessens the initial impact to the helmet. The outer shell is formed into segments of padded material that may deform on impact. The outer shell has an inner surface that allows the outer shell to slide over the surface of a helmet thereby reducing forces applied to a wearer. The helmet cap may be securely attached to helmets without modification of the helmets. The helmet cap may include an adjustable fastener that allows the helmet cap to be securely attached to helmets of varying dimensions.

15 Claims, 13 Drawing Sheets

(56) References Cited

U.S. PATENT DOCUMENTS 2,381,524 A 8/1945 Ivan
2,418,069 A * 3/1947 Delano ..... 2/7
3,031,673 A 5/1962 Korolick
3,155,981 A 11/1964 McKissick et al.
3,174,155 A * 3/1965 Pitman ..... 2/411
3,245,087 A 4/1966 Marchello
3,259,912 A * 7/1966 Lima et al. ..... 2/68
3,445,860 A 5/1969 Rodell
3,529,306 A * 9/1970 Thorne ..... 2/411
3,562,811 A * 2/1971 Allen ..... 2/423
D225,088 S * 11/1972 East ..... D24/207
3,705,466 A * 12/1972 Sela ..... 446/27
3,815,152 A * 6/1974 Bednarczuk et al. ..... 2/9
3,843,970 A * 10/1974 Marietta ..... A42B 3/127 2/415
3,857,117 A * 12/1974 Tenowitz ..... 2/171.03
4,068,323 A * 1/1978 Gwon ..... 2/413
4,100,320 A * 7/1978 Chisum ..... 428/188
4,106,124 A * 8/1978 Green ..... 2/422
4,218,780 A * 8/1980 Growe et al. ..... 2/171
4,223,409 A * 9/1980 Lee ..... 2/411
4,279,038 A 7/1981 Bruckner et al.
4,287,613 A 9/1981 Sculz
4,290,149 A * 9/1981 Aileo ..... 2/414
4,307,471 A * 12/1981 Lovell ..... A42B 3/065 2/411
4,324,005 A * 4/1982 Willis ..... 2/413
4,343,047 A * 8/1982 Lazowski et al. ..... 2/411
4,354,284 A * 10/1982 Gooding ..... 2/413
4,446,576 A * 5/1984 Hisataka ..... A42B 3/24 2/412
4,660,230 A * 4/1987 Mayling ..... 2/413
4,663,785 A * 5/1987 Comparetto ..... 2/413
D292,330 S * 10/1987 McColough ..... D29/106
4,843,642 A 7/1989 Brower
4,937,888 A * 7/1990 Straus ..... 2/411
5,014,365 A * 5/1991 Schulz ..... 2/412
5,075,903 A * 12/1991 Richoux ..... 2/411
5,173,970 A * 12/1992 Shifrin ..... A42B 1/08 2/209.12
5,177,815 A 1/1993 Andujar
5,259,070 A * 11/1993 De Roza ..... 2/413
5,323,492 A * 6/1994 DeMars ..... 2/209.13
5,337,420 A * 8/1994 Haysom et al. ..... 2/410
5,421,035 A * 6/1995 Klose et al. ..... 2/411
RE35,193 E 4/1996 Shifrin
5,515,546 A * 5/1996 Shifrin ..... A42B 3/00 2/209.11
5,544,367 A * 8/1996 March, II ..... A42B 3/00 2/410
5,581,818 A * 12/1996 Lorenzi et al. ..... 2/411
5,661,854 A * 9/1997 March, II ..... A42B 3/00 2/410
5,708,983 A * 1/1998 Cross et al. ..... 2/171
5,729,830 A 3/1998 Luhtala
5,822,803 A * 10/1998 Lorenzi et al. ..... 2/411
5,903,925 A * 5/1999 Engebretson ..... 2/209.13
5,940,890 A * 8/1999 Dallas et al. ..... 2/421
5,953,762 A * 9/1999 Corbett ..... 2/425
6,088,840 A * 7/2000 Im ..... 2/411
D435,698 S * 12/2000 Gill ..... D29/102
D437,472 S * 2/2001 Ruscitti et al. ..... D2/881
6,237,162 B1 * 5/2001 Gill ..... 2/422
6,256,799 B1 * 7/2001 McGlasson et al. ..... 2/422
6,266,827 B1 * 7/2001 Lampe et al. ..... 2/414
6,272,692 B1 * 8/2001 Abraham ..... 2/411
6,292,952 B1 * 9/2001 Watters et al. ..... 2/411
6,314,586 B1 * 11/2001 Duguid ..... 2/411
6,349,416 B1 * 2/2002 Lampe et al. ..... 2/411
6,360,376 B1 * 3/2002 Carrington ..... 2/412
6,381,759 B1 * 5/2002 Katz ..... 2/425
6,381,760 B1 * 5/2002 Lampe et al. ..... 2/425
6,389,607 B1 5/2002 Wood
6,397,399 B1 * 6/2002 Lampe et al. ..... 2/425
6,421,840 B1 * 7/2002 Chen et al. ..... 2/410
6,446,270 B1 9/2002 Durr
6,493,881 B1 * 12/2002 Picotte ..... A42B 1/08 2/413
6,502,586 B2 * 1/2003 Tsai ..... 132/275
6,532,602 B2 * 3/2003 Watters et al. ..... 2/411
D474,577 S 5/2003 Rohde
6,591,428 B2 * 7/2003 Halstead et al. ..... 2/413
6,826,509 B2 11/2004 Crisco, III et al.
6,848,122 B1 * 2/2005 Meeds ..... 2/422
6,871,525 B2 3/2005 Withnall et al.
6,934,971 B2 8/2005 Ide et al.
6,952,839 B2 10/2005 Long
D521,191 S * 5/2006 Berger ..... D29/122
7,089,602 B2 8/2006 Talluri
7,096,512 B2 8/2006 Blair
7,114,198 B1 * 10/2006 Hsieh et al. ..... 2/422
D533,312 S * 12/2006 Bouchez ..... D29/102
7,188,375 B2 * 3/2007 Harrington ..... 2/411
7,240,376 B2 7/2007 Ide et al.
7,254,843 B2 8/2007 Talluri
7,328,462 B1 2/2008 Straus
7,398,562 B2 * 7/2008 Mollo ..... 2/425
7,478,438 B2 1/2009 Lolis
D617,503 S * 6/2010 Szalkowski et al. ..... D29/122
7,743,640 B2 6/2010 Lampe et al.
8,156,569 B2 * 4/2012 Cripton et al. ..... 2/6.8
8,166,573 B1 * 5/2012 Chung et al. ..... 2/411
8,296,863 B2 * 10/2012 Cripton et al. ..... 2/6.8
8,316,512 B2 11/2012 Halldin
8,402,568 B2 * 3/2013 Alstin et al. ..... 2/413
8,631,518 B1 * 1/2014 Jennings ..... 2/411
8,640,267 B1 * 2/2014 Cohen ..... 2/411
8,966,669 B2 * 3/2015 Hines ..... F14H 1/02 2/411
2001/0013140 A1 * 8/2001 Tachi et al. ..... 2/411
2002/0056521 A1 * 5/2002 Chen ..... A42B 3/06 156/410
2003/0005511 A1 * 1/2003 Tao et al. ..... 2/411
2004/0107482 A1 * 6/2004 Picotte ..... A42B 1/08 2/411
2004/0163162 A1 * 8/2004 Benziger ..... 2/411
2005/0198725 A1 * 9/2005 Mollo ..... 2/422
2006/0137073 A1 * 6/2006 Crisco ..... A42B 3/063 2/142
2007/0157370 A1 * 7/2007 Joubert Des Ouches ..... A42B 3/324 2/410
2008/0045871 A1 * 2/2008 Allen ..... 602/17
2008/0083053 A1 4/2008 Lin
2008/0172779 A1 7/2008 Ferguson
2008/0250547 A1 * 10/2008 Frank ..... 2/411
2008/0282453 A1 * 11/2008 Alstin et al. ..... 2/413
2010/0101005 A1 * 4/2010 Cripton et al. ..... 2/411
2011/0179557 A1 * 7/2011 Rabie ..... 2/411
2011/0203024 A1 * 8/2011 Morgan ..... F41H 1/04 2/2.5
2011/0302700 A1 12/2011 Vito et al.
2012/0066820 A1 3/2012 Fresco
2012/0102630 A1 * 5/2012 Anderson ..... 2/413
2012/0151663 A1 * 6/2012 Rumbaugh ..... 2/411
2012/0180201 A1 * 7/2012 Cripton et al. ..... 2/411
2012/0233745 A1 * 9/2012 Veazie ..... 2/413
2012/0260406 A1 10/2012 Green et al.
2012/0297525 A1 * 11/2012 Bain ..... 2/411
2012/0317705 A1 * 12/2012 Lindsay ..... 2/413
2013/0031700 A1 * 2/2013 Wacter et al. ..... 2/411
2013/0276213 A1 * 10/2013 Olsson et al. ..... 2/413
2013/0283503 A1 * 10/2013 Zilverberg ..... 2/411
2013/0283504 A1 * 10/2013 Harris ..... 2/411
2014/0259309 A1 9/2014 Pettersen
2014/0373256 A1 12/2014 Harris
2015/0000013 A1 1/2015 Pettersen

OTHER PUBLICATIONS

Gwin, "An Investigation of the NOCSAE Linear Impactor Test Method Based on In Vivo Measures of head Impact Acceleration in American Football", Journal of Biomechanical Engineering, Jan. 2010, vol. 132, 011006-1 to 011006-9.

(56) References Cited

OTHER PUBLICATIONS

Harris, "Effects of Shock and Vibration on Humans", Shock and Vibration Handbook, 2002, Chapter 42, 5th Edition, 1350-1457.
Harris, "Dynamic Vibration Absorbers and Auxiliary Mass Dampers", Shock and Vibration Handbook, 2002, Chapter 6, 5th Edition, 197-238.
Manoogian, "Analysis of Linear Head Accelerations From Collegiate Football Impacts", MS Thesis, Virginia Polytechnic Institute and State University, Apr. 22, 2005, 51 pages.
Rigby et al., "Using Helmet Sensors in Predicting Head Kinematics", NATO Science and Technology Organization, Paper 29 presented at the RTO Human Factors and Medicine Panel (HFM) Symposium held in Halifax, Canada, Oct. 3-5, 2011, 18 pages.
Viano, "Change in Size and Impact Performance of Football Helmets from the 1970's to 2010", Annals of Biomedical Engineering, Jan. 2012, vol. 40, No. 1, 175-184.
Håkansson et al., "Resonance frequencies of the human skull in vivo", Journal Acoustical Society America, Mar. 1994, 1474-1481, 95(3).

* cited by examiner

PROTECTIVE HELMET CAP

CROSS-REFERENCE TO RELATED APPLICATION

This application is a continuation-in-part of, and claims priority to, U.S. patent application Ser. No. 13/738,542, filed Jan. 10, 2013, which claims priority to U.S. Provisional Patent Application No. 61/585,073, filed Jan. 10, 2012. Both U.S. patent application Ser. No. 13/738,542 and U.S. Provisional Patent Application No. 61/585,073 are entitled "Protective Helmet Cap" and both are incorporated by reference herein in their entireties.

TECHNICAL FIELD

The present invention is directed generally to the field of sporting goods and more specifically, to protective helmet covers.

BACKGROUND

Concussions are traumatic brain injuries usually caused by a bump, blow, or jolt to the head that has the potential to affect normal brain function. It has been discovered that some concussions are caused by rotational velocities of the head and sudden decelerations of the brain. In addition, the numerous sub-concussive impacts that athletes are experiencing every day are leading to cognitive impairment. Some head injuries may initially appear to have no long-lasting effects, but current research is finding that many such injuries, such as concussions, may have serious, long-term effects. The likelihood of long-term effects may be further increased when one has experienced repeated head injuries or cumulative concussions.

The Head Injury Criterion (HIC) is often used to measure the likelihood of head injury arising from an impact. The HIC can be used to assess safety related to vehicles, personal protective gear, and sports equipment. HIC is typically defined by the formula shown below.

$$HIC = \left\{ \left[ \frac{1}{t_2 - t_1} \int_{t_1}^{t_2} a(t)dt \right]^{2.5} (t_2 - t_1) \right\}_{max}$$

In this formula, $t_1$ and $t_2$ are the initial and final times (in seconds) of the interval during which HIC attains a maximum value, and acceleration is measured in g's (standard gravity acceleration). The maximum time duration of HIC, $t_2-t_1$, is limited to a specific value, usually 15 ms. Studies have found that concussions are found to occur at HIC=250 among athletes.

The Gadd Severity Index (SI) is another commonly used measure of the injury potential of an impact. SI is typically defined by the formula shown below.

$$SI = \int_0^T a^{2.5} dt$$

In this formula, a(t) is the acceleration-time pulse of the impact and T is the duration of the impact. This formula can be interpreted as the area under the acceleration time pulse, after the acceleration values have been exponentiated to the power 2.5. An SI score of 1000 approximates the limit of human tolerance. Impacts with an SI score higher than 1000 have a greater than zero probability of causing a life-threatening brain trauma.

In order to combat concussions and other head injuries in sporting activities, protective helmets are commonly worn whenever there is a possibility of injury to the head. For example, protective helmets are commonly worn in football, hockey, baseball, lacrosse, motor sports, extreme sports, and winter snow sports. Such helmets are intended to reduce the severity of impacts to the wearer's head and in some cases to reduce vibrations experienced by the wearer's head. Such helmets often do not sufficiently reduce impact severity and do not reduce vibrations. Moreover, such helmets often do not reduce rotational forces transmitted to the wearer's head during impact events.

Various test methods have been used to assess the impact performance of protective helmets. For example, U.S. Pat. No. 7,743,640 issued to Lampe describes a linear impact test method, where a weighted headform fitted with a helmet is propelled by a linear ram into another headform fitted with a helmet. Headform accelerations of the resulting impact are measured using accelerometers mounted within the headform. U.S. Pat. No. 6,871,525 issued to Withnall describes a method and apparatus for testing a football helmet using a weighted pendulum arm. A helmet is fitted onto a headform and the pendulum arm is raised and then dropped to impart an impact force upon the helmet. Headform accelerations resulting from the impact are measured using accelerometers mounted within the headform. U.S. Pat. No. 6,826,509 issued to Crisco describes a head mounted sensor system (HMSS) that can include a standard football helmet in which a plurality of accelerometers and a radio transmission device mounted. The instrumented helmet can be worn by players during practice and/or games. Accelerations sustained by a player's head can be measured using the in-helmet accelerometers. Acceleration data can then be transmitted to a radio receiving device and associated computing equipment providing "in vivo" acceleration data for helmet impacts sustained by a helmet wearer during practice and/or game play.

The publication "An Investigation of the NOCSAE Linear Impactor Test Method Based on In Vivo Measures of Head Impact Acceleration in American Football" (Journal of Biomechanical Engineering, Vol. 132, pp. 011006-1 to 011006-9) by Gwin provides a comparison between the linear impact test method and National Operating Committee for Standards in Athletic Equipment (NOCSAE) standard drop tests for Riddell Revolution helmets. Gwin further presents a correlation between linear impact testing and in-vivo data collected using in-helmet systems such as HMSS. Daniel presents in-vivo helmet impact statistics for youth, high school and collegiate players for that relate the number of impacts experienced during a season of play to the impact severity. The publication "Head Acceleration Measurements in Helmet-Helmet Impacts and the Youth Population" (MS Thesis, Virginia Polytechnic Institute and State University, Blacksburg Va., Apr. 16, 2012) by Daniel presents in vivo helmet impact statistics for youth, high school, and collegiate players for that relate the number of impacts experienced during a season of play to the impact severity. The publication "Analysis of Linear Head Accelerations From Collegiate Football Impacts" (MS Thesis, Virginia Polytechnic Institute and State University, Blacksburg Va., Apr. 22, 2005) by Manoogian presents similar in vivo statistics for collegiate players including a correlation between the number of impacts and resulting HIC. Manoogian presents HIC data for a group of nearly 10,000 hits, wherein the median HIC is 3.1.

Over the years, protective helmets have evolved with advances in technology. For example, U.S. Pat. No. 7,328,462 issued to Straus is directed to a protective helmet of the type used in football and has an external soft elastomer layer to absorb/dissipate some of the energy of an impact. Other features include a quick disconnect face guard, carbon fiber face guard with Kevlar wrap at junction points, a soft foam inner shell inside the intermediate hardened shell, and a head fitting structure including a plurality of pads, visco-elastic cells, and at least one inflatable bladder. In addition, the hardened shell may be formed as a lattice frame of strips having a plurality of fibers impregnated with resin. The resin may have a dye added that will indicate if and where an impact exceeding a predetermined value is incurred by the helmet to assist a physician in diagnosing a possible head trauma injury.

Strauss also developed a ProCap, worn by some players in the 1990's. The original ProCap was a tough polyurethane foam shell permanently attached to a standard hard helmet with Velcro.

U.S. Pat. No. 7,089,602 issued to Talluri is directed to a multi-layered, impact absorbing, modular helmet in which the preferred embodiment consists of two layers over the hard casing. The outermost layer consists of an air chamber ensconced within a highly durable polymeric material with one or more air pressure release valves.

U.S. Pat. No. 6,446,270 issued to Durr is directed to a sports helmet with an energy absorbent material such as vinyl nitrile sponge (VNS) being a combination of thermoplastic polyvinyl chloride and synthetic elastomer nitrile.

U.S. Pat. No. 4,287,613 issued to Schulz, U.S. Pat. No. 6,934,971 issued to Ide, and U.S. Pat. No. 7,240,376 issued to Ide describe prior-art football helmets. The publication "Change in Size and Impact Performance of Football Helmets from the 1970s to 2010" (Annals of Biomedical Engineering, Vol. 40, No. 1, January 2012, pp. 175-184) by Viano provides a comparison of prior-art football helmets, including differences in dimensions, construction, and impact performance.

U.S. Patent Application Publication No. 2011/0302700 filed by Vito et al. is directed to a vibration reducing headgear worn inside a helmet consisting of two layers of material.

U.S. Pat. No. 8,316,512 issued to Halldin describes a helmet with multiple hard shell layers that allow relative sliding between inner and outer hard shell layers.

Despite the use of protective helmets, concussions continue to occur in sports. In 2004, data collected from the head impact telemetry system used in the National Football League concussion studies found that 58 of 623 (9.8 percent) of professional football players who suffered a concussion also had a loss of consciousness.

Moreover, recent studies show that more than 62,000 concussions occur each year in high school sports, with football accounting for two of every three, according to the Brain Injury Association of Arizona. However, many more mild concussions likely go undiagnosed and unreported. Studies estimate that approximately 10 percent of all athletes involved in contact sports such as football have a concussion each year. In addition, close to 60 percent of concussions may go unreported because athletes are not aware of the signs and symptoms and do not think the injury is serious enough to report to medical personnel.

Failure to detect initial concussions may lead to compound concussions, which can cause second impact syndrome. Second impact syndrome is a condition in which a second concussion occurs before a first concussion has properly healed, causing rapid and severe brain swelling and often catastrophic results. Second impact syndrome can result from even a very mild concussion that occurs days or weeks after the initial concussion. Most cases of second impact syndrome have occurred in young athletes, particularly those who participate in sports such as baseball, football, hockey, and skiing. Second impact injury can occur within a matter of days or weeks, or even in the same game or competition if the athlete isn't removed and treated after the first concussion. Neither impact has to be severe for second impact syndrome to occur.

Several studies have shown a link between a history of brain injury and a higher probability of developing major depression later in life. Another study found that of 2,552 retired professional football players, over 11 percent of those with a history of multiple concussions also had a diagnosis of clinical depression. Players reporting three or more previous concussions were three times more likely to be diagnosed with depression than those with no history of concussion. Emerging research also shows cumulative damage and onset of Chronic Traumatic Encephalopathy after multiple concussions. Thus, there is risk that even lesser impacts can lead to long-term damage.

As a result of increased public awareness regarding concussions, sports leagues of all levels have updated their concussion policies. However, these policies typically only deal with treatment of players after a concussion has already occurred and do not address concussion prevention.

With advancements in athletic training methods and new workout supplements, today's athletes are bigger and stronger than ever, thereby increasing the potential for concussions. As a result, traditional protective helmets are no longer sufficient to protect against concussions. What is lacking in the art is a protective helmet to help combat the rise in concussions in sporting activities.

SUMMARY

In the present disclosure, a helmet cap is disclosed that may include an outer shell configured into a plurality of padded segments and configured to attach to a helmet. Each of the plurality of padded segments may comprise energy absorbing polyurethane material. The helmet cap may include at least one strap attachment point for attaching a strap to the outer shell of the helmet. The at least one strap attachment point may be configured to facilitate attachment of the helmet cap to a football helmet facemask. The helmet cap may be constructed with ear holes, ventilation gaps, and/or an adjustable fastener that, when manipulated, alters the internal dimensions of the helmet cap. The adjustable fastener may use hook-and-loop fasteners. Each of the padded segments of the helmet cap may have a substantially rectangular shape, a substantially trapezoidal shaped, a substantially hexagonal shape, a combination thereof, or any combination of these and/or any other shapes. Each padded segment may have at least one convex edge that facilitates a ventilation gap configured in the outer shell. In an alternative embodiment, the disclosed helmet cap may not have multiple segments but may rather be a single contiguous padded segment.

The disclosed helmet cap may have an inner surface that allows the helmet cap to slide against or over a helmet on which it is configured, thereby dissipating forces applied to the helmet when the helmet is impacted by an object. Each of the plurality of padded segments of the helmet cap may independently deform upon impact with in object, further reducing the forces that are ultimately applied to the wearer of the helmet on which the helmet cap is configured.

The disclosed helmet cap may be used with a variety of helmets, including football helmets, baseball batting helmets, and any other helmets used in sporting activities. The helmet cap may have a smooth inner surface providing a low friction layer between the outer shell and the helmet's rigid hard shell creating a decoupled outer cover for reduction in forces that may be applied to a helmet during an impact. Alternatively, the helmet cap may have inner surface constructed of honeycomb material providing a low friction layer between the outer shell and the helmet providing ventilation for cooling and decoupling the outer cover from the hard shell of helmet to reduce forces that may be applied to a helmet during an impact. The outer shell of the helmet cap may be constructed of material having a low coefficient of friction. Each of the plurality of padded segments may be constructed from rebound foam, closed-cell foam, neoprene foam, viscoelastic polymer gel, memory foam, or any combination thereof of any combination of other materials. Any of the materials used for the helmet cap may be waterproof. The disclosed helmet cap may be constructed from two sections that may be manufactured as flat sections and which form a helmet shape upon attachment to one another. These and other aspects of the subject matter disclosed are set forth below.

BRIEF DESCRIPTION OF DRAWINGS

The foregoing and other aspects of the present invention will be better understood from the following detailed description with reference to the following drawings.

DETAILED DESCRIPTION

The subject matter of the various embodiments is described with specificity to meet statutory requirements. However, the description itself is not intended to limit the scope of the disclosed subject matter. Rather, the inventor has contemplated that the claimed subject matter might also be embodied in other ways, to include different steps or elements similar to the ones described in this document, in conjunction with other present or future technologies. It should be understood that the explanations illustrating the protective helmet are only exemplary. The following description is illustrative and not limiting to any one aspect.

When values are expressed as approximations, by use of the antecedent "about," it will be understood that the particular value forms another embodiment. All ranges are inclusive and combinable. It is to be appreciated that certain features of the disclosed subject matter which are, for clarity, described herein in the context of separate embodiments, may also be provided in combination in a single embodiment. Conversely, various features of the disclosed subject matter that are, for brevity, described in the context of a single embodiment, may also be provided separately or in any sub-combination. Further, reference to values stated in ranges includes each and every value within that range. Any and all documents cited in this application are incorporated herein by reference in their entireties.

Figure 1:
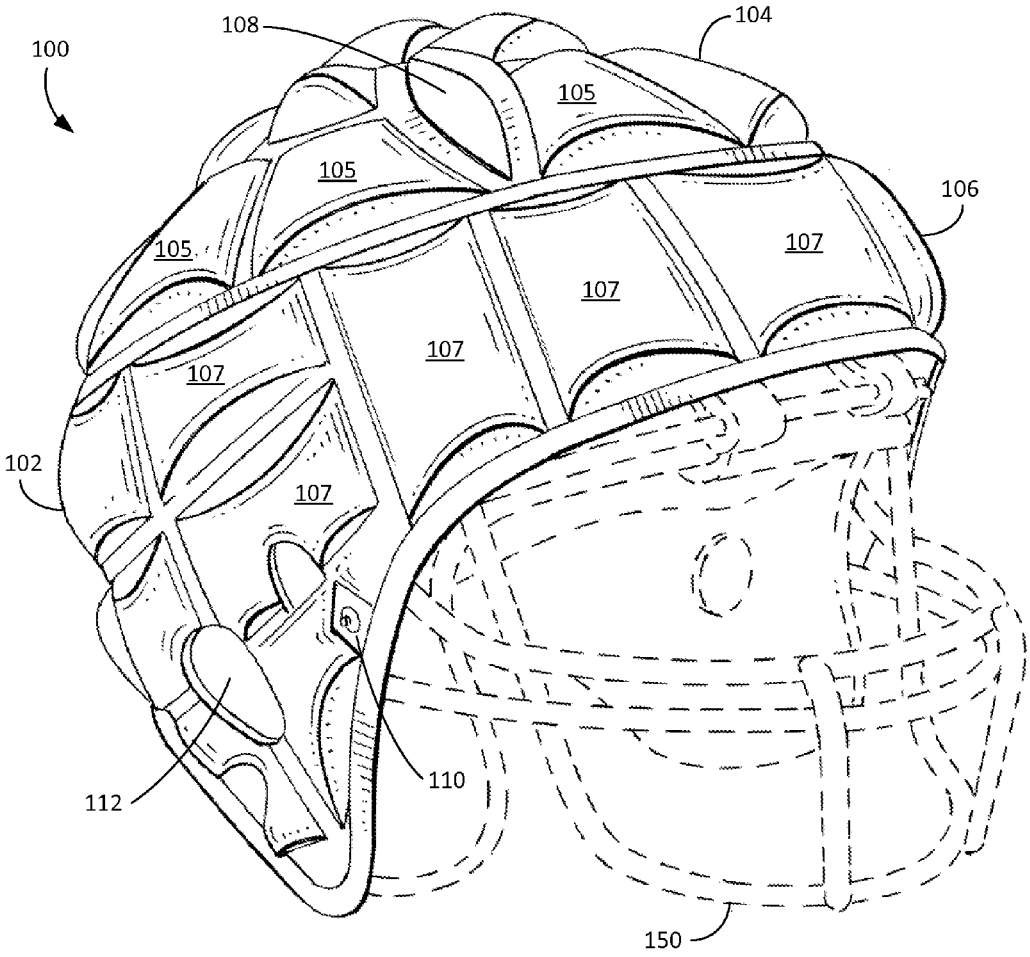
FIG. 1 illustrates a perspective view of an exemplary helmet cap configured on a helmet.

FIG. 1 is a perspective view of exemplary helmet cap 100, shown configured on an exemplary football helmet 150 (drawn in dashed lines). In one embodiment, helmet cap 100 may be a cover for traditional football helmets. However, helmet cap 100 may be used with any existing helmet, including, but not limited to, helmets used in baseball, hockey, lacrosse, bike, skateboard, winter snow sports, rock climbing, and motorsports. In addition, adaptations may include a protective cap that is worn directly on the head and not as a cover for an existing helmet. Helmet cap 100 may be configured on any type of helmet or headgear intended for any sporting use or any other purpose. Football helmet 150 is used herein as a non-limiting example of a contemplated application of helmet 150.

Helmet cap 100 may include an outer shell 102. Outer shell 102 may be comprised of a soft, energy absorbing, durable material. The material may have a low coefficient of friction. The durable material may allow helmet cap 100 to resist tears, for example, during the helmet to helmet collisions that frequently occur in football games. A low coefficient of friction allows the objects that come into contact with helmet cap 100 to deflect off outer shell 102.

Concussions are the result of rapid changes in velocities between the brain and the skull. A collision between the two disrupts the delicate neuronal layer of the brain by an extent relative to the magnitude of acceleration and the player's physiology. By reducing the accelerations, concussions may be prevented. Since momentum is the product of mass and velocity, transfer of momentum is inversely proportional to the deflection of the impacted surface. For example, ⅛" deflection instead of 1/16" deflection will result in the transfer of half as much momentum. A low coefficient of friction allows for greater deflection thereby reducing the transfer of momentum, which in turn assists in reducing the accelerations.

In some embodiments, outer shell 102 material may also have density, stiffness, and energy absorbing properties designed for a particular application. Optimizing such properties of the outer shell 102 material reduce the severity of an initial impact, such as a helmet to helmet collision. Since force is the product of mass and velocity, the longer that the impact can be extended, the lower the velocity and therefore the lower the magnitude of the resulting force. The soft outer shell 102 may dampen and redistribute the force generated by a head to head collision.

Furthermore, the soft outer shell 102 material may also prevent the helmet from being used as a weapon in sporting events. When there are hits to the hand, knee, leg, arm, or other parts of the body, the force is greatly reduced by outer shell 102 in comparison to hard plastic shelled helmets.

The material of outer shell 102 may also be waterproof and lightweight allowing helmet cap 100 to be attached on top of existing protective helmets without adding significant additional weight while still remaining useable under all weather conditions. Alternatively, the material of outer shell 102 may be further enclosed in waterproof material.

In one embodiment, outer shell 102 material may be, at least in part, soft, energy absorbing polyurethane. In another embodiment, outer shell 102 material may be, at least in part, rebound foam, closed-cell foam, neoprene foam, viscoelastic polymer gel, memory foam, or any other energy absorbing foam, or any combination thereof. Outer shell 102 may be comprised of any soft, durable material with energy absorbing properties and a low coefficient of friction, any combination of such materials, or any combination of any other one or more materials and any one or more soft, durable material with energy absorbing properties and a low coefficient of friction.

Outer shell 102 may be configured in the form of a plurality of shapes or segments as illustrated in FIG. 1, and may be comprised of upper section 104 and lower section 106. Any pattern of shapes or segments may be used. For example, some or all of the segments in lower section 106, as shown in FIG. 1, may be substantially rectangular and configured in various numbers of rows, as seen with lower segments 107. For example, a single row of segments may be configured in the front of lower section 106 while two or more rows of segments may be configured on the sides and rear of lower section 106. One or more sides of each shape may be concave or convex. In another example, some of the segments in upper section 104 may be rectangular, hexagonal, or trapezoidal in shape, such as segments 105, while other segments may be triangular in shape. Here again, each segment may have one or more sides that are at least somewhat convex or concave. In some embodiments, concave sides to segments may facilitate the configuration of gaps 108 (discussed in more detail below), other openings, and/or ventilation points. Note that not all segments are labeled in each drawing discussed herein so that clarity of the figures may be maintained.

The segmented formation may assist in deflecting objects on impact. Additionally, the segmented formation may also help in lessening the force of impact when helmet 150 configured with helmet cap 100 collides with another object, such as another helmet, goal post, the ground, etc. Even further reduction of the force of impact may be had when two or more helmets, each with caps such as helmet cap 100 attached, collide. A soft, energy absorbing polyurethane material used for outer shell 102 configured into a plurality of segments may reduce the Head Injury Criteria by as much as 33%, if not more, in comparison traditional hard shelled football helmets.

In an embodiment, upper section 104 may comprise gaps 108, which may allow helmet cap 100 to mold and fit securely over an existing helmet, regardless of the underlying helmet's size. Furthermore, gaps 108 may allow the user's head to be well ventilated. Gaps 108 may be holes or alternatively, they may be covered with an elastic breathable or perforated material or fabric. In some other embodiments, helmet cap 100 may not have any gaps 108 at all.

Lower section 106 of helmet cap 100 may be configured with securing strap attachment points 110. Securing strap attachment points 110 may be constructed of an elastic material for secure attachment of helmet cap 100 to helmet 150. By using an elastic material for securing strap attachment points 110, helmet cap 100 may be permitted to move about helmet 150 and thereby dissipate energy received during an impact, reducing the linear and/or rotational forces applied to helmet 150 during the impact. Securing strap attachment points 110 may allow the attachment of a strap or other component that secures helmet cap 100 to helmet 150. For example, a strap may be secured to one of securing strap attachment points 110 and may be attached to the facemask of underlying helmet 150. Alternatively, a strap may be affixed to the underside of helmet cap 100 and placed around a facemask section of helmet 150 and secured to one of securing strap attachment points 110. There may be two such straps, one on each side of helmet cap 100, and each attached to a respective securing strap attachment points 110 (first securing strap attachment point 110 seen in FIG. 1, second securing strap attachment point 110 shown in FIG. 3). The securing straps used with securing strap attachment points 110 may be nylon, an elastic material, or any other material that allows the straps to be secured to the facemask of a football helmet. The securing straps may be configured for attachment on another type of helmet, or configured for directly positioning helmet cap 100 on the head.

Note that a helmet cap according to the present disclosure may be secured attached, affixed, or otherwise configured on a helmet using any other means. For example, helmet cap 100 may be attached to the underlying helmet via means other than securing straps, such as adhesive, clips, snaps, or hook-and-loop fasteners (e.g., VELCRO®). Securement means used to configure a helmet cap as disclosed on a helmet may secure the cap at any section of the helmet. In one embodiment, as set forth above, securement means may attach a cap at a facemask section of helmet. Alternatively, securement means may attach a cap at one or more points near or on the edges of a helmet. Any securement means, whether permanent or temporary, and any location of attachment to a helmet for such means, are contemplated as within the scope of the present disclosure.

In an embodiment, an attachment system may be used that allows the helmet cap to be slidingly displaced upon impact relative to a helmet shell on which the helmet cap is configured. Alternatively, rather than the entirety of the helmet cap sliding or being displaced, individual padded segments of a helmet cap and/or groups of padded segments of a helmet cap may slide and displace during an impact while one or more other segments do not slide and/or displace. In such embodiments, such a helmet cap and/or one or more padded segments thereof may deform in those areas on which an impact or blast may impinge. Any securement means allowing such deformation and displacement is contemplated as within the scope of the present disclosure.

Helmet cap 100 may also include ear holes 112. Ear holes 112 may correspond to existing ear holes in existing helmets of any type. Ear holes 112 may allow the wearer of the helmet cap 100 to be able to hear sounds their surroundings while utilizing helmet cap 100 and may add to the ventilation normally associated with the helmet type. Any type, number, size, and shape of ear holes may be used in helmet cap 100, while in other embodiments, helmet cap 100 may not include any ear holes 112. For example, in situations where the underlying hard shell helmet does not cover the ears, helmet cap 100 may not have any ear holes 112. Alternatively, if there is underlying helmet that covers the ears but does not have earholes, then helmet cap 100 may not have ear holes 112.

Figure 2:
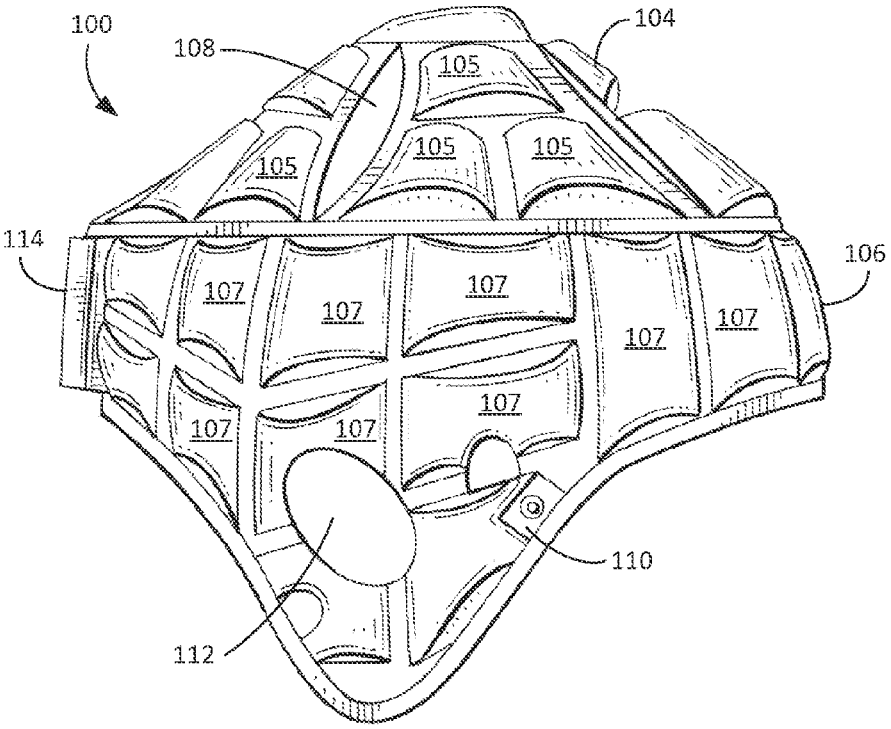
FIG. 2 illustrates a side view of an exemplary helmet cap.
Figure 3:
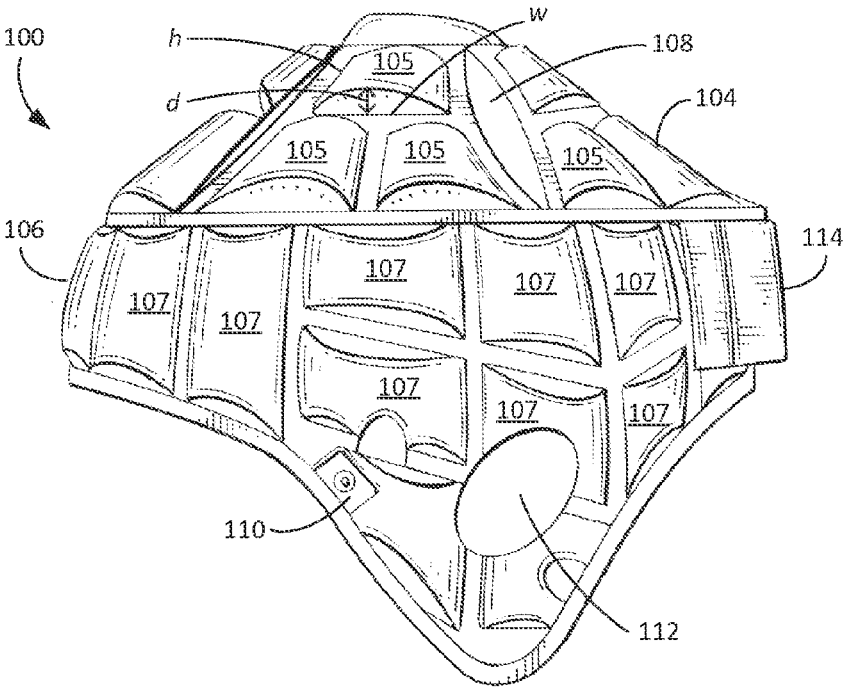
FIG. 3 illustrates another side view of an exemplary helmet cap.

FIG. 2 illustrates a side view of helmet cap 100. Shown in FIG. 2 are upper section 104, lower section 106, segments 105 and 107, gaps 108, ear holes 112, one of securing strap attachment points 110, and the segments discussed above. FIG. 3 illustrates the side view opposite that of FIG. 2, also showing upper section 104, lower section 106, segments 105 and 107, gaps 108, ear holes 112, one of securing strap attachment points 110, and the segments discussed above. FIG. 3 also illustrates the dimensions in which one or more of the segments 105 and 107 may be configured. Each of the segments 105 and 107 may be configured to have a first dimension h, which may be referred to as the height of the segment 105 and 107 and may be substantially parallel to an axis running from the lower section 106 to the upper section 104. Each of the segments 105 and 107 may be configured to have a second dimension w, which may be referred to as the width of the segment 105 and 107 and may be substantially normal to the axis running from the lower section 106 to the upper section 104. Each of the segments 105 and 107 may further be configured to have a third dimension d, which may be referred to as the depth of the segment 105 and 107 and may be substantially normal to the surface of the outer shell 102. In other words, the third dimension d may represent the maximum thickness of the segment 105 and 107 or the maximum distance that the segment 105 and 107 protrudes from the outer shell 102. The segment 105 and 107 may be configured so that the third dimension d is less than one or both of the first dimension h and the second dimension w.

Also shown in FIGS. 2 and 3 is adjustable fastener 114 that may allow helmet cap 100 to be placed on top of helmets of different sizes. Manipulation of adjustable fastener 114 may allow the adjustment of the internal dimensions of helmet cap 100 so that helmet cap 100 may be securely attached to helmets of various sizes. Adjustable fastener 114 may be constructed of any material, including plastic, elastic, or any other material that allows helmet cap 100 to be adjusted to fit over an underlying helmet. Adjustable fastener 114 may use hook-and-loop fasteners, snaps, buckles, or any other type of securing means to secure adjustable fastener 114 about a helmet. In other embodiments, helmet cap 100 does not have adjustable fastener 114 and, instead, may be fitted for a particular underlying helmet size. In yet other embodiments, helmet cap 100 may be constructed of an elastic material that stretches about a helmet and contracts on a helmet to secure helmet cap 100 to the helmet.

Figure 4:
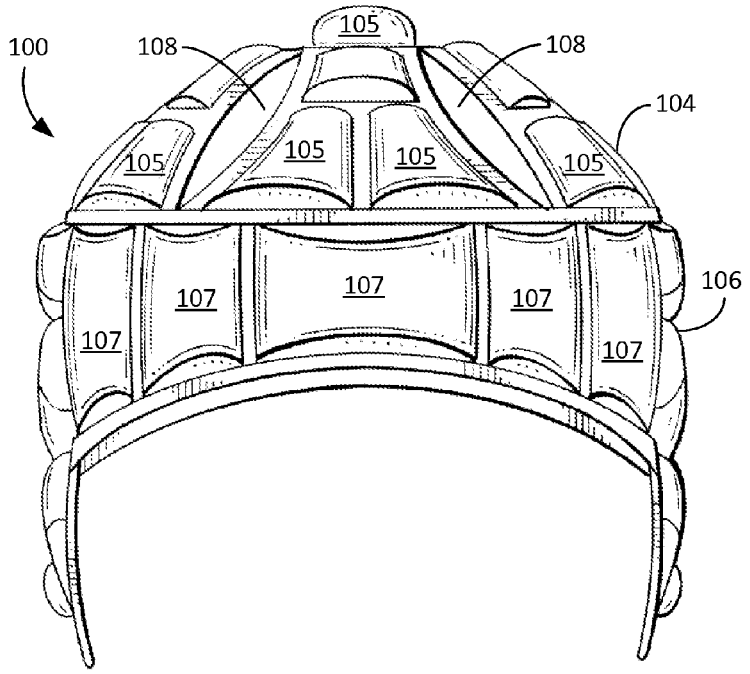
FIG. 4 illustrates a front view of an exemplary helmet cap.

FIG. 4 illustrates a front view of helmet cap 100. Shown in FIG. 4 are upper section 104, lower section 106, segments 105 and 107, gaps 108, and the segments discussed above. As can be seen in this figure, in an embodiment there may be several gaps 108 configured in helmet cap 100. Also seen in this figure are the segments in upper section 104 configured in three rows, with the lower two rows of segments in upper section 104 having substantially trapezoidal shapes with one or more convex sides facilitating the placement of gaps 108 that may be oval or lens shaped. Any other shapes and sizes of segments and gaps 108 are contemplated as within the scope of the present disclosure.

Figure 5:
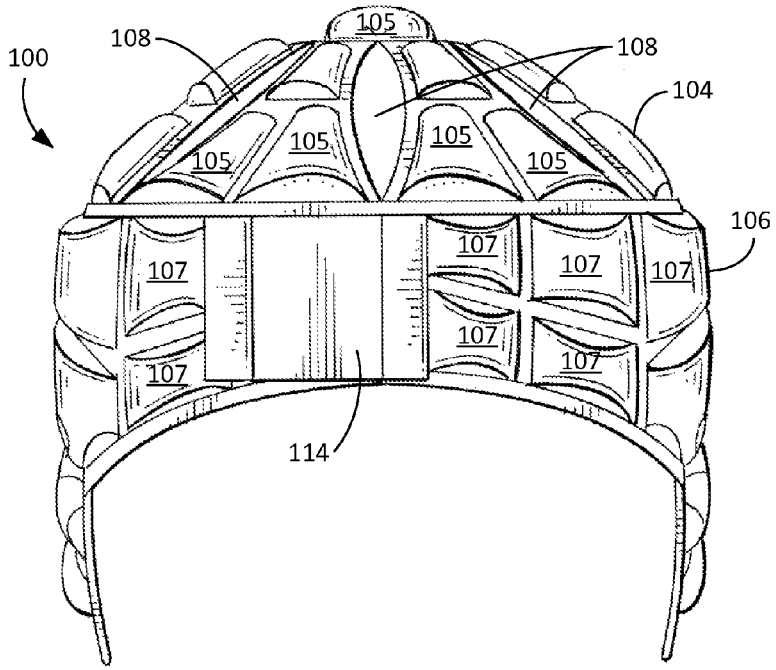
FIG. 5 illustrates a rear view of an exemplary helmet cap.

FIG. 5 illustrates a rear view of helmet cap 100. Shown in FIG. 5 are upper section 104, lower section 106, segments 105 and 107, adjustable fastener 114, and the segments discussed above. As can also be seen in this figure, in an embodiment there may be several gaps 108 configured in helmet cap 100. As with FIG. 4, some of the segments in upper section 104 may have substantially trapezoidal shapes with one or more convex sides facilitating the placement of gaps 108 that may be oval or lens shaped. Any other shapes and sizes of segments and gaps 108 are contemplated as within the scope of the present disclosure. Also shown in FIG. 5 is adjustable fastener 114 that may allow helmet cap 100 to be secured to helmets of different sizes.

Figure 6:
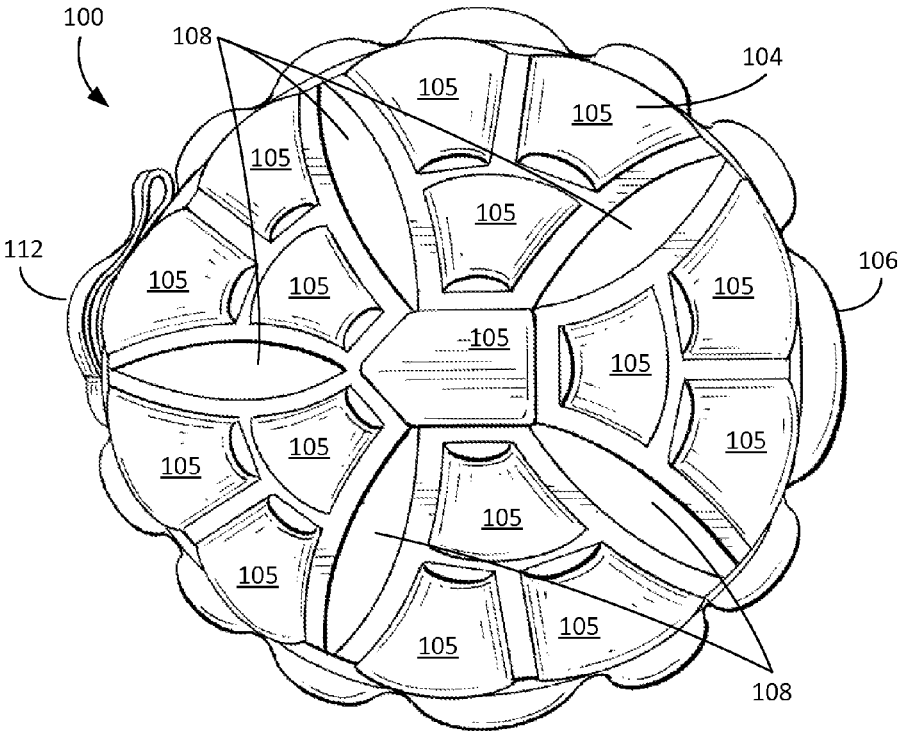
FIG. 6 illustrates a top view of an exemplary helmet cap.

FIG. 6 illustrates a top view of helmet cap 100. Shown in FIG. 6 are upper section 104, lower section 106, segments 105 and 107, gaps 108, adjustable fastener 114, and the segments discussed above. As can also be seen in this figure, in an embodiment there may be several gaps 108 configured in helmet cap 100. As with FIGS. 4 and 5, some of the segments in upper section 104 may have substantially trapezoidal shapes with one or more convex sides facilitating the placement of gaps 108 that may be oval or lens shaped. Also clearly shown here is a top segment that is substantially pentagonal in shape, but any shape and quantity of top segments are contemplated. Any other shapes and sizes of segments and gaps 108 are contemplated as within the scope of the present disclosure. Also shown in FIG. 5 is adjustable fastener 114 that may allow helmet cap 100 to be secured to helmets of different sizes.

Figure 7:
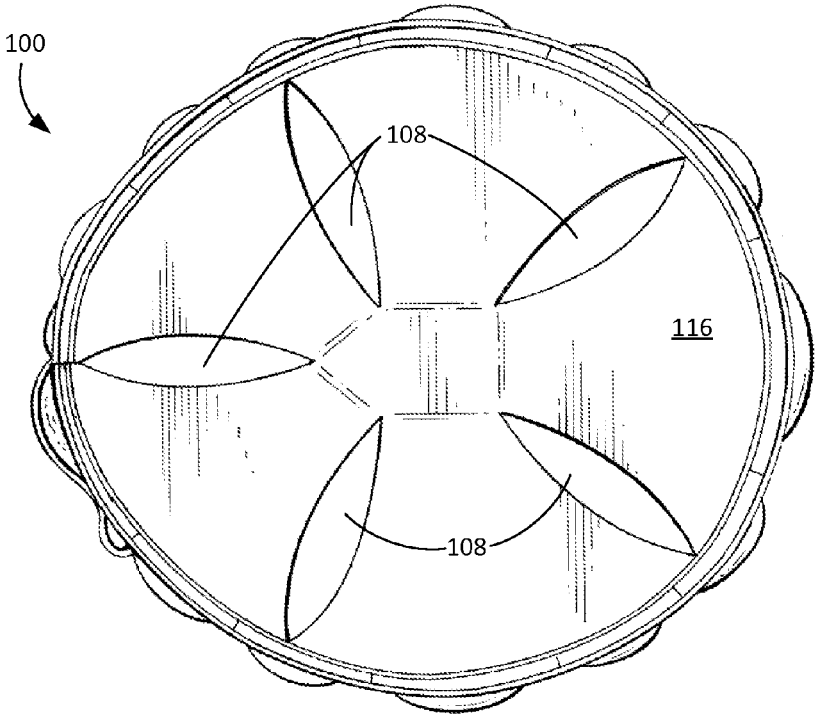
FIG. 7 illustrates a bottom view of an exemplary helmet cap.

FIG. 7 illustrates and bottom or internal view of helmet cap 100. In one embodiment, helmet cap 100 may have an inner surface 116. Inner surface 116 may be smooth allowing helmet cap 100 to mold with the underlying helmet. In another embodiment, inner surface 116 may be of a material that allows movement between helmet cap 100 and the helmet. This movement may be helpful in dissipating the energy received during an impact, thereby reducing the linear and/or rotational forces applied to the helmet during the impact. Such a material may allow helmet cap 100 to slide against the surface of a helmet on which it is configured upon impact with an object, thereby dissipating the energy received during the impact and forces applied to the helmet. In an embodiment, honeycomb material may line the inside of helmet cap 100 to provide a frictional layer to prevent the protective cap from slipping on the hard outer shell of the helmet to which helmet cap 100 is secured. Also shown in FIG. 7 are gaps 108, demonstrating an embodiment where gaps 108 allow ventilation through helmet cap 100 and also allow helmet cap 100 to be flexible and expand or contract as needed to fit over various sizes of helmets.

Figure 8:
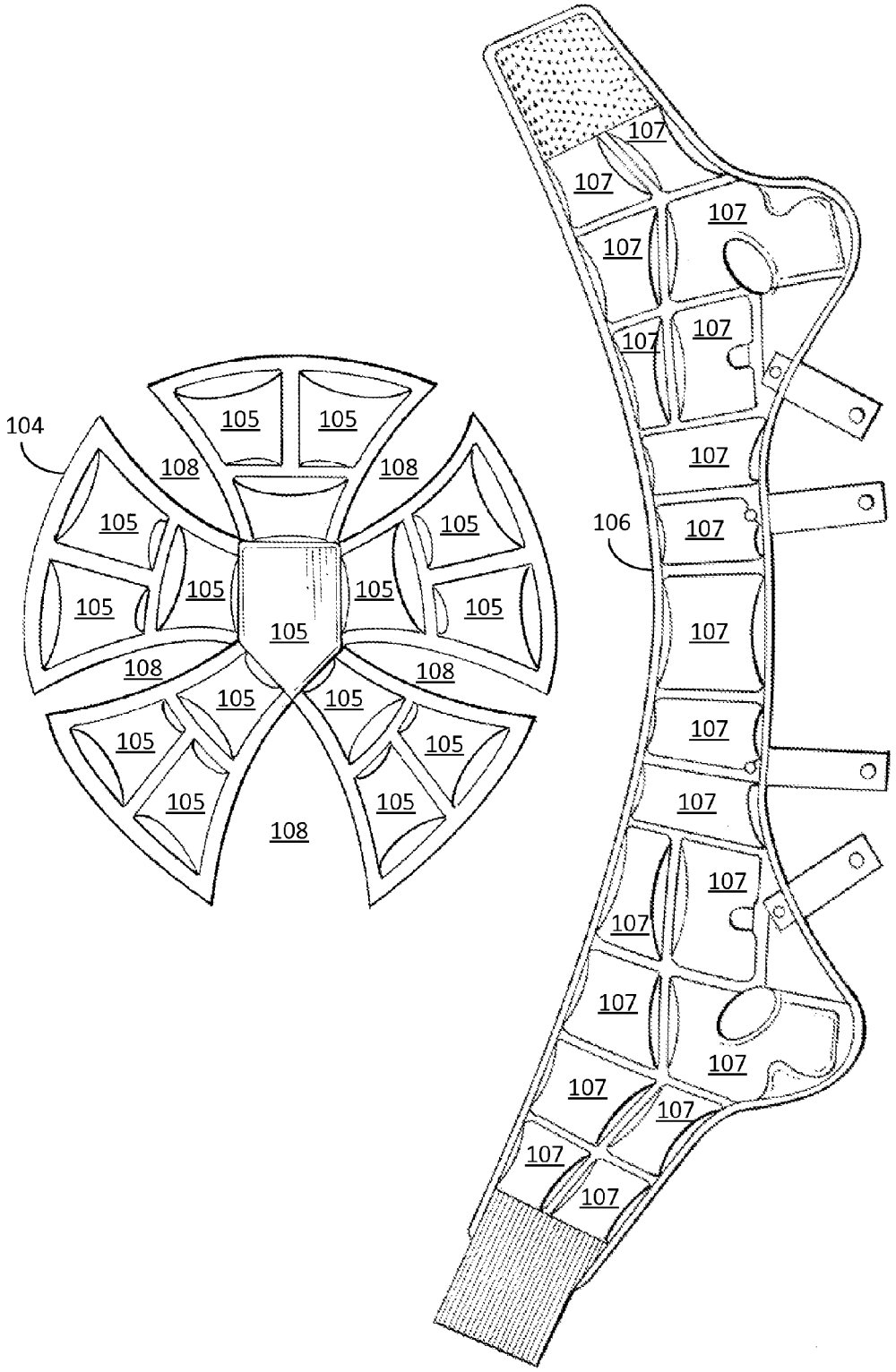
FIG. 8 illustrates a top view of two sections of an unassembled exemplary helmet cap.

FIG. 8 illustrates upper section 104 and lower section 106 separately. Upper section 104 and lower section 106 may be manufactured as flat panels or sections with various padded segments as shown in previous figures. The shapes and sizes of padded segments 105 and 107 and gaps 108 may cooperate in a manner that causes flat sections 104 and 106 to conform to a spherical shape such as a football helmet when sewn or otherwise attached together as shown, for example, in FIGS. 1 through 6. This arrangement may ensure that all areas of a helmet surface may be sufficiently protected by padded segments while providing for flat-manufacture of comprising sections, which may reduce manufacturing costs and difficulty. Other shapes and arrangements of flat sections are contemplated as within the scope of the present disclosure.

While the present application has been described in connection with a helmet cap, or cover, it is contemplated that there may be a helmet comprising an integrated helmet cap as described above combined with a hardened inner shell and a foam interior. The hardened inner shell may be comprised of synthetic fibers, such as aramid fibers and para-aramid fibers, polycarbonate, or hardened plastics. The hardened inner shell may comprise one or a plurality of holes for ventilation. Such holes may correspond to gaps in the integrated helmet cap such as gaps 108 described above. In one embodiment the hardened inner shell may have two ear holes, allowing for communication. In other embodiments, the hardened inner shell and is smooth and uniform, without any holes.

The foam interior may be comprised of any energy-absorbing foam. In one embodiment, the foam interior uses vinyl nitrile foam. Alternatively, thermo plastic urethane foam, expanded polystyrene foam, and/or expanded polypropylene foam may be used. The foam may also be water proof or water resistant so as to not absorb sweat or rain that may add weight during use. Additionally, the foam interior may be configured in one or a plurality of cells.

In use, the segments of helmet cap 100 may be constructed, at least in part, of soft urethane material connected to one with connecting material such that an impact on one segment will deform that segment and thereby absorb and dissipate the energy of an impact. A detailed description of such an impact is now provided.

Figure 9A:
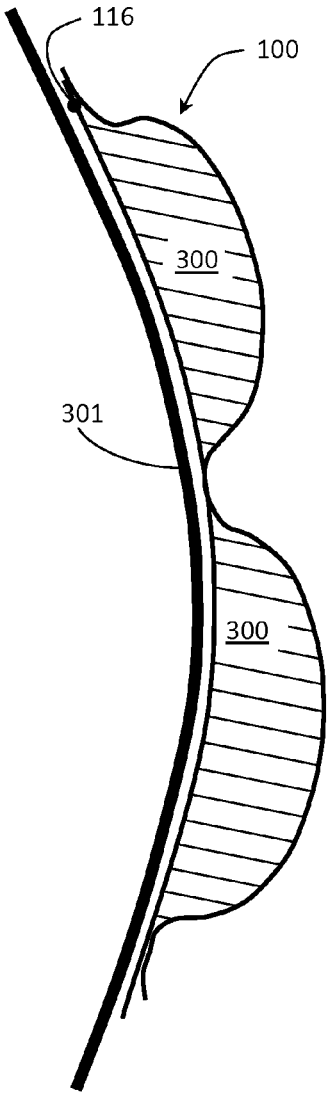
FIG. 9A illustrates a cross-sectional view of two exemplary undeformed padded segments of an exemplary helmet cap.
Figure 9B:
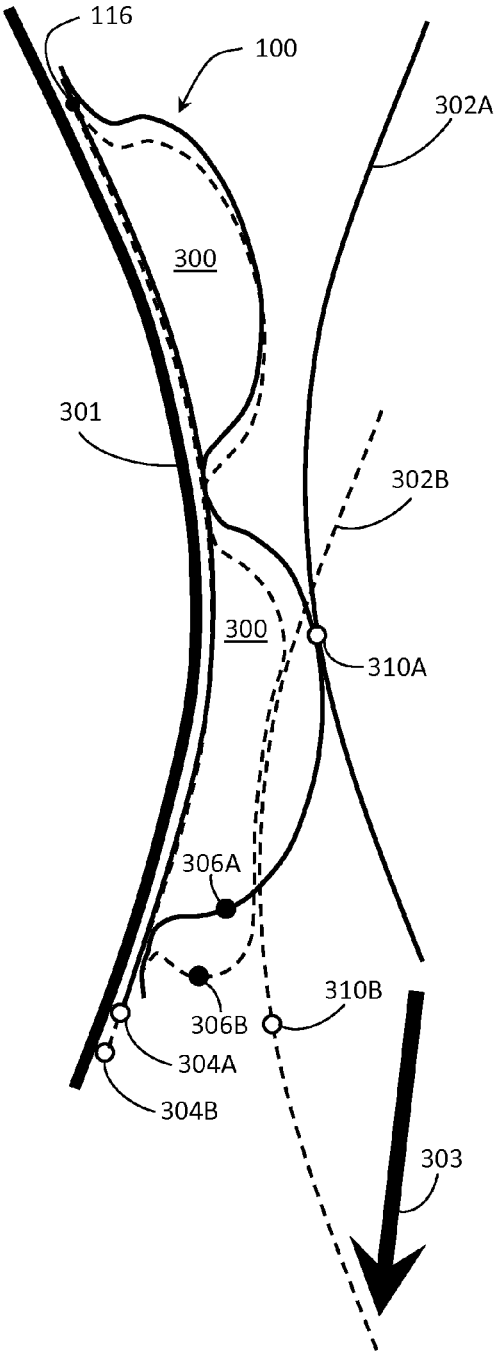
FIG. 9B illustrates a cross-sectional view of two exemplary deformed padded segments of an exemplary helmet cap.

FIG. 9*a* represents an enlarged cross-sectional view of a section of helmet cap 100. FIG. 9*b* represents an enlarged cross-sectional view of a section of helmet cap 100 subjected to an oblique or glancing impact by another object (cross-sectional hatching omitted for clarity). Padded segments 300 shown in FIGS. 9A and 9B represent any padded segments on any helmet cap implemented according to the instant disclosure, including segments 105 and 107 shown in FIGS. 1-8. When helmet cap 100 is attached to a hard shell helmet, padded segments 300 may slip and deform along the exterior surface of the helmet, moving between the helmet shell and an impacting object while the shell and the object are in contact. This relative motion may reduce peak impact forces and may subsequently reduce the severity of any resulting head rotational forces, such as forces that are tangential to the helmet wearer's head. In FIG. 9B, a portion of helmet cap 100 is shown disposed near outer surface 301 of a hard shell helmet.

Location 304A in FIG. 9B represents an initial position of a point on cap 100 adjacent helmet outer surface 301. The position of an outer surface of an impacting object such as another hard shell helmet is represented by solid line 302A (showing the position of impacting object prior to impact) and dashed line 302B (showing the position of impacting object in a latter stage of impact), with the direction of motion of the impacting object indicated by arrow 303. Contact point 310A represents the point of contact of the impacting object before impact (i.e., at position 302A) with helmet cap 100. As the outer surface of the impacting object moves from position 302A toward position 302B, various displacements may occur with respect to cap 100 and helmet outer surface 301. Portions of cap 100 that are adjacent helmet outer surface 301 may slide and displace as represented by location 304A of helmet cap moving to location 304B. Such sliding displacement may be enabled by the low friction layer of inner surface 116 of helmet cap 100 that may be adjacent to the helmet's hard shell 301 and that may provide a decoupled outer cover.

Another type of displacement may occur due to mechanical deformation of one or more padded segments 300. The position of segment 300 is represented by location 306A (prior to impact) and location 306B (latter stage of impact). Note that the distance between 306A and 306B represents the displacement of cap 100 from 304A to 304B and an additional displacement due to mechanical deformation of segment 300 (e.g., downward deflection indicated by arrow 303). In this manner, padded segments may stretch in a tangential direction with respect to helmet outer surface 301. This may cause portions of the helmet cap to displace relative to the helmet and also relative to other portions of the helmet cap that may be attached to the helmet (e.g., only a portion of the cap displaces relative to the helmet). Note that such tangential stretching may also occur in a helmet cap consisting of a single section, where a portion of the single section helmet cap may displace relative to the helmet. Padded segment 300 may also be compressed toward helmet outer surface 301, absorbing impact forces in a direction that is normal to the wearer's head.

Initial contact point location 310A may have been displaced past cell 300 to location 310B due to the impacting object sliding against the low coefficient of friction material on outer shell 102. The deflection of segment 300 may cause a relatively large contact area with the impacting object (e.g., when the impacting object is at position 302B) that may prevent high contact pressures that could cause stiction or adherence between helmet cap 100 and the impacting object. Note that the impacting object may continue to slide past outer shell 102 until contact is lost. Any or all of the aforementioned displacements and any other displacements may be facilitated by elements of helmet cap 100, and thus helmet cap 100 may perform as a decoupled helmet cap. It will be appreciated that the outer surface of the impacting object may also be another helmet cap 100 configured on a second helmet. It will also be appreciated that padded segments of other shapes may provide the same decoupling effects. Vibration attenuations provided by embodiments of the invention are considered next.

Hard shell helmets are known to vibrate in response to impacts, having vibrational modes with frequencies ranging from about 100 Hertz (Hz) to nearly 1000 Hz (see, e.g., the publication "Using Helmet Sensors in Predicting Head Kinematics" by Paul Rigby et al. (NATO Science and Technology Organization, Paper 29 presented at the RTO Human Factors and Medicine Panel (HFM) Symposium held in Halifax, Canada on 3-5 Oct. 2011)). The human skull is known to have vibrational modes with frequencies ranging from about 300 Hz to about 900 Hz (see, e.g., the publication "Harris' Shock and Vibration Handbook", Chapter 42, Cyril M. Harris, editor, Allan G. Piersol, editor (5th edition, 2002)). It will be appreciated that soft liners or padding systems often used inside hard shell helmets may not be effective for preventing helmet shell vibrations from being transmitted to the wearer's head. Such soft liners and padding systems may also tend to cause vibration of the combined hard shell and liner to occur at lower frequencies than the bare helmet shell, for example as low as about 5 Hz to about 150 Hz.

The disclosed embodiments may suppress vibrations of hard shell helmets that might otherwise be transmitted to the wearer's head. Referring again to FIG. 9A, padded segments 300 may be adjacent to hard shell helmet surface 301 but not directly attached or adhered to surface 301. This arrangement may provide a plurality of independent elastomer vibration snubbers (or auxiliary mass dampers see, e.g., the publication "Harris' Shock and Vibration Handbook", Chapter 6, Cyril M. Harris, editor, Allan G. Piersol, editor (5th edition, 2002)) that may reduce vibrations of the hard shell helmet, with each padded segment acting as an independent snubber. In some embodiments, for example as shown in FIGS. 1-8, padded segments may be of different sizes and masses and therefore have different natural frequencies and may thereby dampen different frequencies. Relatively larger padded segments may have relatively lower natural frequencies. Relatively smaller padded segments may have relatively higher natural frequencies. This may provide helmet cap 100 with the capability to suppress a plurality of frequencies that may include helmet vibrational frequencies and vibrational frequencies of helmets with inner liners or internal padding. By using padded segments of varying sizes and/or masses, a range of vibrational frequencies may be suppressed by properly selecting the size and mass of individual padded segments when constructing helmet cap 100.

Experiments were conducted to assess vibration suppression of various embodiments described herein. In one experiment, two prior-art helmets were suspended by nylon cords in a pendulum arrangement. The nylon cords were approximately six feet in length, and each helmet was suspended by two cords. When hanging from the cords, the helmets were oriented such that they made contact with each other near the front above the helmet facemask. The helmets were then separated using a spacing object. When the spacing object was removed, the helmets were allowed to swing downward and make impact with each other. An acoustic meter was placed near one of the helmets, oriented such that the microphone of the acoustic meter was disposed into the interior of one helmet. The acoustic meter detects pressure oscillations created by vibrations within the helmet interior. An oscilloscope was used to process the voltage output of the acoustic meter into time and frequency representations. This test was then repeated a second time but with one of the helmets fitted with a helmet cap embodiment as described herein.

Figure 10:
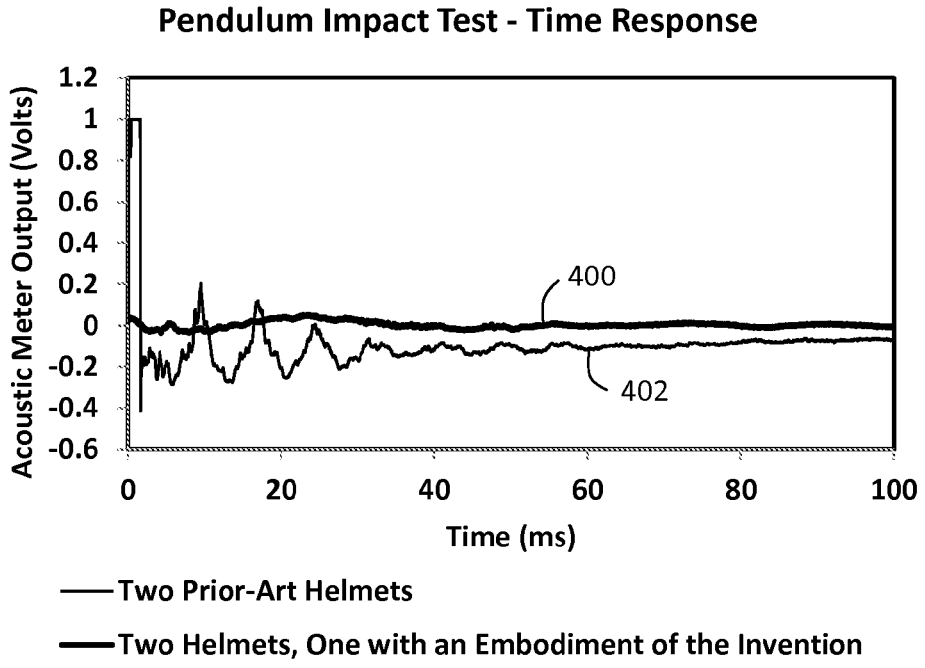
FIG. 10 is a chart illustrating a comparison of test results of an exemplary helmet cap and a prior art helmet cap.
Figure 11:
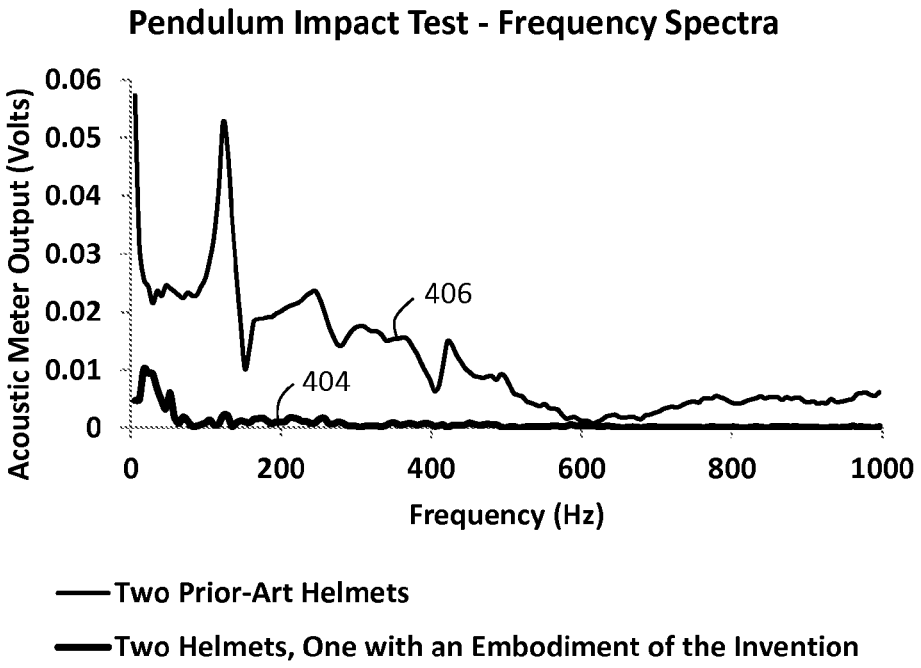
FIG. 11 is a chart illustrating a comparison of test results of an exemplary helmet cap and a prior art helmet cap.

FIGS. 10 and 11 illustrate the time response and frequency spectra for these two experiments. Referring to FIG. 10, time response signal 402 indicates results recorded on the impact of the two prior art helmets (i.e., neither helmet being configured with a helmet cap embodiment) and time response signal 400 indicates results recorded on the impact of one prior art helmet with one helmet configured with a helmet cap embodiment. FIG. 10 illustrates that embodiments of the invention reduce the amplitude of impact noise within the helmet interior.

Referring now to FIG. 11, frequency response signal 406 indicates results recorded on the impact of the two prior art helmets (i.e., neither helmet being configured with a helmet cap embodiment) and time response signal 404 indicates results recorded on the impact of one prior art helmet with one helmet configured with a helmet cap embodiment. FIG. 11 illustrates that a plurality of vibrational frequencies are dampened by an embodiment according to the instant disclosure. For example, vibrational peaks near 125 Hz and 425 Hz are significantly reduced.

Figure 12:
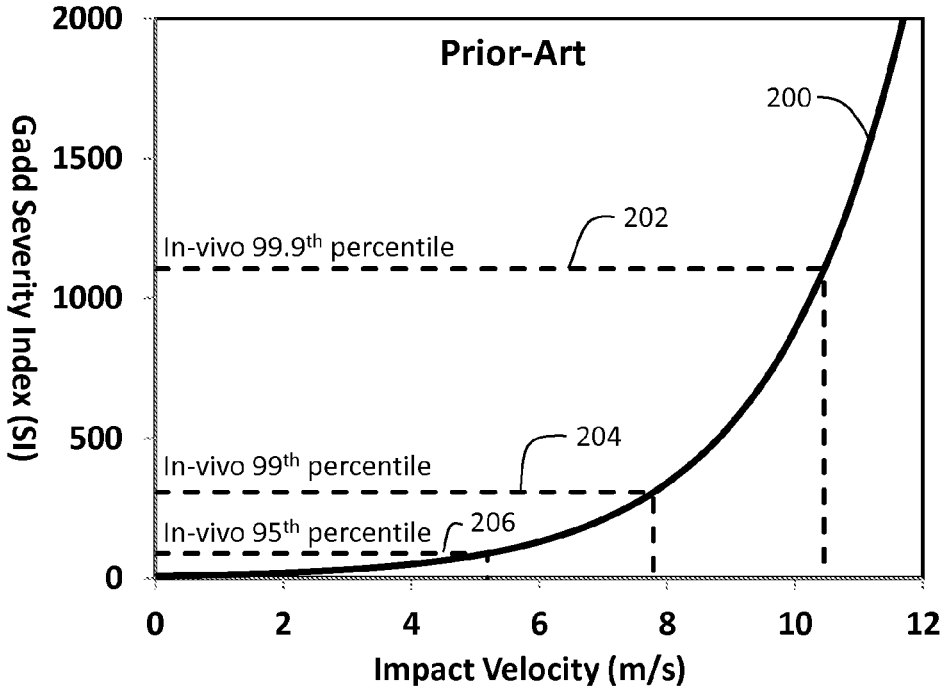
FIG. 12 is a chart illustrating a correlation between linear impact test results and in vivo data for helmet impacts.

FIGS. 12-16 illustrate advantages provided by embodiments of the present disclosure in reducing impact severity, namely Severity Index (SI) and Head Injury Criterion (HIC). The previously-referenced publication by Gwin provides a correlation between linear impact test results and in vivo data for helmet impacts. FIG. 12 represents this correlation, where Severity Index curve 200 represents SI severity against equivalent linear impact speed (in meters per second). Impact velocity represents the speed of the impacting element relative to the helmet just prior to impact. Gwin states that impact speed and equivalent player closure speed (e.g., combined speed of players prior to contact) are similar. Bins 202, 204, and 206 represent the 99.9th, 99th, and 95th percentile SI scores (respectively) for in vivo hits experienced within the range of indicated speeds (using, in GWIN, a Riddell Revolution helmet). Note that the Y-intercept for the curve fit provided by Gwin is SI=7.31. This is inconsistent with the previously-presented equation for SI because an impact with zero velocity should have zero acceleration and thus an SI score of zero.

Figure 13:
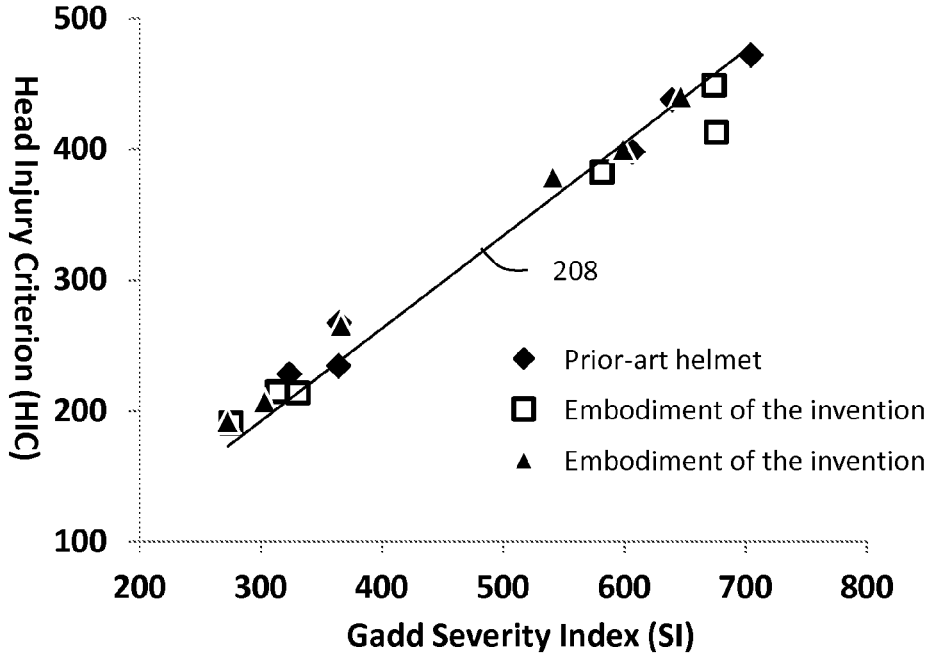
FIG. 13 is a chart illustrating linear impact data for a helmet configured with an exemplary helmet cap and a prior art helmet cap.

FIG. 13 is a plot of linear impact data of a prior-art football helmet, and a prior-art football helmet fitted with embodiments of the present disclosure at different impact speeds. Impact speed represents the speed of the impacting element relative to the helmet just prior to impact. Close-correlation between HIC and SI for impact tests is known in the art. FIG. 13 confirms the close correlation between HIC and SI for a prior art helmet and a prior art helmet fitted with embodiments of the present disclosure. The linear relationship between HIC and SI may be represented by linear fit 208.

Figure 14:
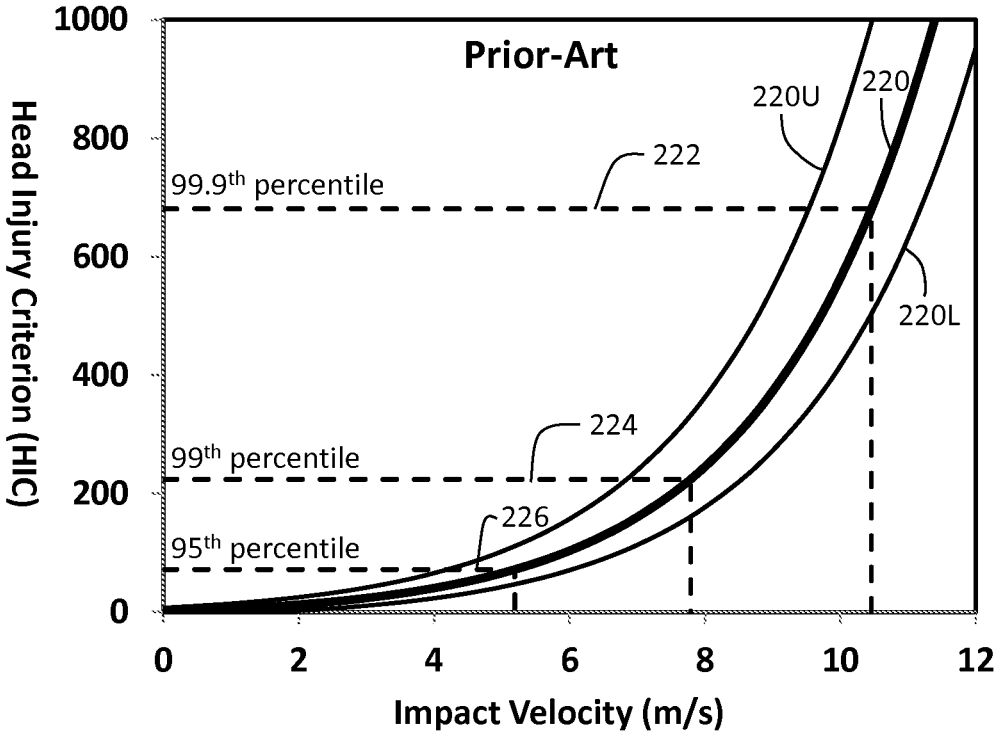
FIG. 14 is a chart illustrating a correlation between linear impact test results and in vivo data for helmet impacts.

FIG. 14 is a plot similar to FIG. 12 but shows Riddell Revolution helmet HIC data from the publication by Viano (referenced above) as plotted by applicant. HIC curve 220 represents HIC against equivalent linear impact speed (in meters per second). Bins 222, 224 and 226 represent the 99.9th, 99th, and 95th percentile HIC scores (respectively) calculated using velocities from FIG. 12. Upper HIC boundary 220U and lower HIC boundary 220L represent the upper and lower boundaries (respectively) of HIC scores for a Riddell Revolution helmet and other prior-art football helmets tested using linear impact and/or drop test methods. Note that these data have been plotted with a Y-intercept of zero to be consistent with an HIC score of zero at zero impact velocity.

Figure 15:
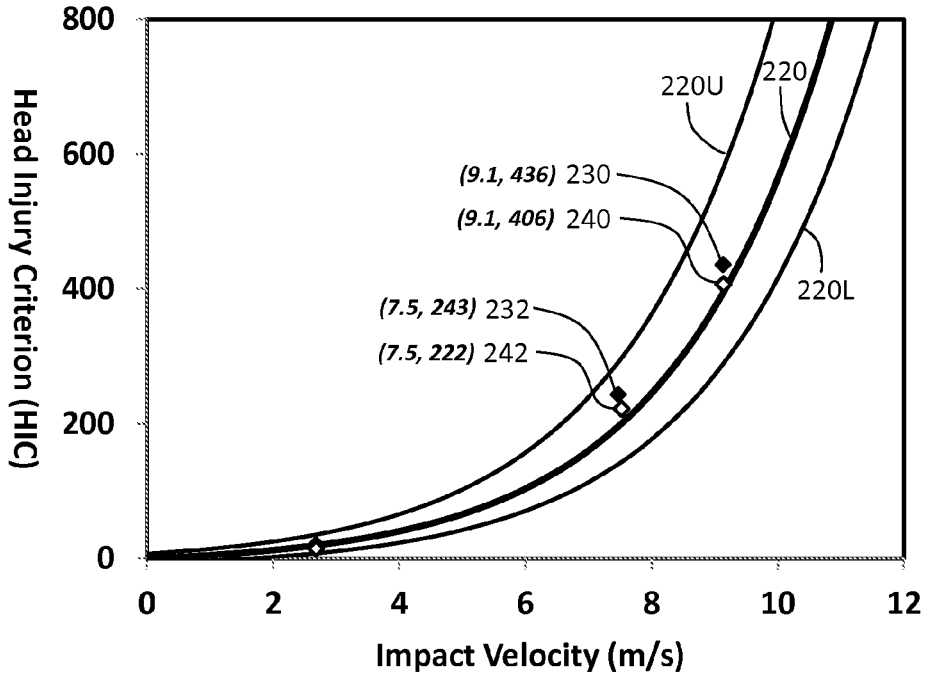
FIG. 15 is a chart a comparison of test results of an exemplary helmet cap and a prior art helmet cap.
Figure 16:
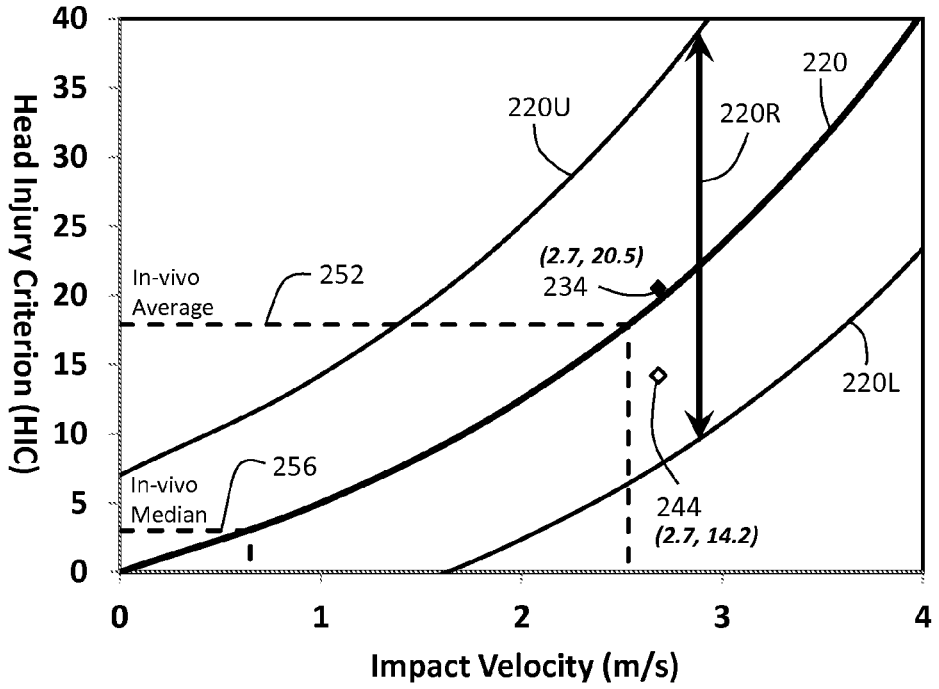
FIG. 16 is a chart a comparison of test results of an exemplary helmet cap and a prior art helmet cap.

FIGS. 15 and 16 show plots of test data for prior art helmets and for prior-art helmets used with embodiments of the disclosure. Referring to FIG. 15, data points for a prior-art helmet are shown as 230 and 232 while data points for a helmet fitted with an embodiment of the disclosure are shown as 240 and 242. FIG. 16 is an expansion of the lower-left portion of FIG. 15. In FIG. 16, point 234 indicates data recorded for a prior-art helmet and point 244 indicates data recorded for a prior-art helmet used with helmet cap embodiment. The arrow denoted as 220R represents the range between lower HIC boundary 220L and upper HIC boundary 220U anywhere along HIC curve 220. HIC boundaries 220U and 220L represent the upper and lower boundaries (respectively) for prior-art helmets subjected to impact testing. Bin 252 represents the average range of impacts according to the publication by Manoogian (referenced above), where 83% of all impact occur at or below a velocity of about 2.5 m/s. Bin 256 represents the median range of impacts according to Manoogian, wherein 50% of all impacts occur at or below a velocity of 0.65 m/s. The disclosed embodiments may provide HIC reductions at the tested impact velocities and superior impact reduction near conditions that define an average impact.

Figure 17:
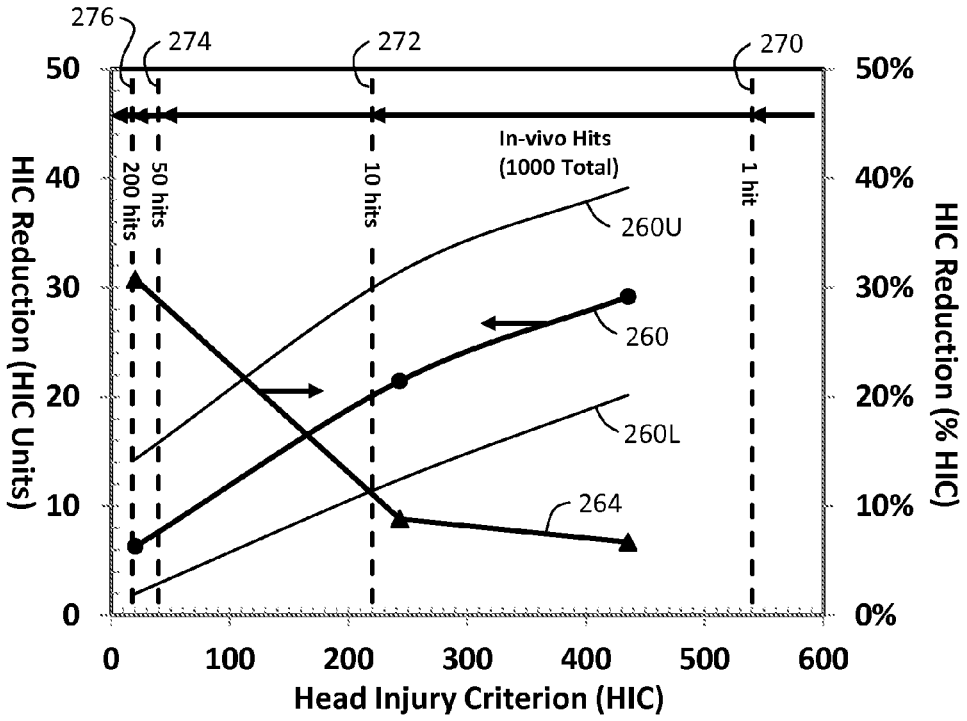
FIG. 17 is a chart illustrating test results of an exemplary helmet cap.
Figure 18:
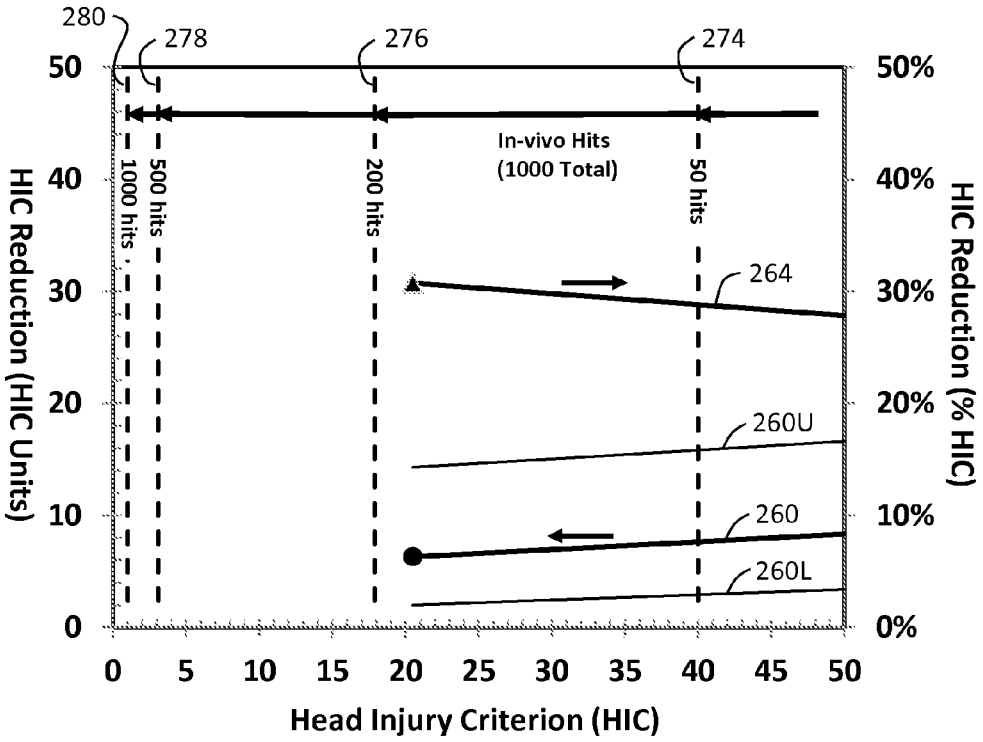
FIG. 18 is a chart illustrating test results of an exemplary helmet cap.

FIGS. 17 and 18 illustrate plots of HIC reductions that may be provided by the disclosed embodiments. FIGS. 17 and 18 are re-plots of data presented in FIGS. 15 and 16. FIG. 17 plots reductions in HIC for embodiments according to impact severity. HIC is plotted on the horizontal axis and reduction in HIC is plotted on the two vertical axes, where the left vertical axis represents reduction in HIC units and the right vertical axis represents % HIC reduction. Line 260 represents the reduction in HIC units for an embodiment (left vertical axis), where line 262L and 262U represent lower and upper boundaries for HIC reduction for embodiments used with various prior-art helmets. Lines 270, 272, 274 and 276 represent a "hit count" for impacts of various severity, where more numerous hits occur at lower HIC. FIG. 18 illustrates an expansion of the left portion of FIG. 17. Lines 278 and 280 represent "hit count" for 500 and 1000 hits (respectively).

Table 1 below provides numerical values for FIGS. 17 and 18, wherein ranges of HIC improvement are provided for embodiments of the invention and for preferred embodiments of the invention.

TABLE 1

| HIC Reductions resulting from the use of embodiments of the disclosure | | |
|---|---|---|
| Nominal Helmet HIC | Helmet HIC Range (220R) | HIC Reduction from use of disclosed embodiments |
| 21 | 8 to 35 | 2 to 16 |
| 243 | 140 to 300 | 12 to 31 |
| 436 | 290 to 580 | 20 to 40 |

Explosive blast-induced head motion has been identified as a contributor to concussions in soldiers by Goldstein et al. in the publication "Chronic Traumatic Encephalopathy in Blast-Exposed Military Veterans and a Blast Neurotrauma Mouse Model" (Science Translational Medicine 4, 134ra60, 2012). The present embodiments may reduce such explosive blast induced head motions in the same manner as previously described for impacts. Cushioning provided by the padded segments of the disclosed embodiments may reduce the severity of pressure pulses transmitted to a helmet shell and resulting head accelerations during an explosive blast. Decoupling provided by movement of the disclosed helmet cap relative to the helmet shell may also reduce rotational accelerations induced upon the wearer's head by an explosive blast. Blast-induced helmet shell vibrations may also be reduced by vibration suppression provided by embodiments of the invention.

Figure 19:
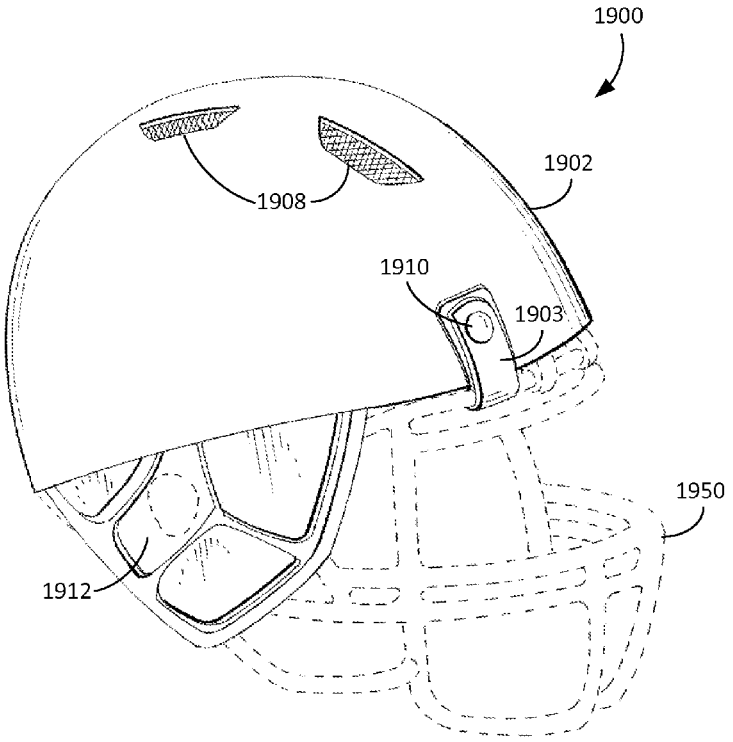
FIG. 19 illustrates a perspective view of an exemplary helmet cap configured on a helmet.

In other embodiments, a helmet cap may include an outer shell that may be a single section with a single smooth, uniform surface without multiple segments or shapes formed into the outer shell (e.g., a single section made up of a single integrated padded segment). An example of such a cap is illustrated in FIG. 19, showing exemplary helmet cap 1900 configured on an exemplary football helmet 1950 (drawn in dashed lines). In one embodiment, helmet cap 1900 may be a cover for traditional football helmets. However, helmet cap 1900 may be used with any existing helmet, including, but not limited to, helmets used in baseball, hockey, lacrosse, bike, skateboard, winter snow sports, rock climbing, and motorsports. In addition, adaptations may include a protective cap that is worn directly on the head and not as a cover for an existing helmet. Helmet cap 1900 may be configured on any type of helmet or headgear intended for any sporting use or any other purpose. Football helmet 1950 is used herein as a non-limiting example of a contemplated application of helmet 1950.

Helmet cap 1900 may include an outer shell 1902. Outer shell 1902 may be comprised of a soft, energy absorbing, durable material. The material may have a low coefficient of friction. The durable material may allow helmet cap 1900 to resist tears, for example, during the helmet to helmet collisions that frequently occur in football games. A low coefficient of friction allows the objects that come into contact with helmet cap 1900 to deflect off outer shell 1902 and may allow helmet cap 1900 to move about helmet 1950. In some embodiments, outer shell 1902 material may also have density, stiffness, and energy absorbing properties designed for a particular application. The material of outer shell 1902 may also be waterproof and lightweight allowing helmet cap 1900 to be attached on top of existing protective helmets without adding significant additional weight while still remaining useable under all weather conditions. Alternatively, the material of outer shell 1902 may be further enclosed in waterproof material. Any of the materials and construction methods described herein may be used to construct helmet cap 1900.

In an embodiment, helmet cap 1900 may comprise holes 1908 that may allow the user's head to be ventilated. Holes 1908 may be open holes or may be covered with an elastic breathable or perforated material or fabric.

Helmet cap 1900 may be configured with securing strap 1903 that may connect to attachment point 1910. Such securing straps and attachment points may be constructed of any material and form as described herein, including elastic material, for secure attachment of helmet cap 1900 to helmet 1950. Elastic materials for securing straps and attachment points may permit helmet cap 1900 to move about helmet 1950 and thereby dissipate energy received during an impact, reducing the linear and/or rotational forces applied to helmet 1950 during the impact. Securing strap 1903 and attachment point 1910 may allow the attachment of a strap or other component that secures helmet cap 1900 to helmet 1950. For example, a strap may be secured to attachment point 1910 and may be attached to the facemask of underlying helmet 1950. Alternatively, a strap may be affixed to the underside of helmet cap 1900 and placed around a facemask section of helmet 1950 and secured to attachment point 110. There may be two such straps, one on each side of helmet cap 1900 (second strap obscured in FIG. 19), and each attached to a respective securing strap attachment point. The securing straps used may be nylon, an elastic material, or any other material that allows the straps to be secured to the facemask of a football helmet. The securing straps may be configured for attachment on another type of helmet, or configured for directly positioning helmet cap 1900 on the head.

Note that helmet cap 1900, as with any helmet cap disclosed herein, may be secured attached, affixed, or otherwise configured on a helmet using any other means. For example, helmet cap 1900 may be attached to the underlying helmet via means other than securing straps, such as adhesive, clips, snaps, or hook-and-loop fasteners (e.g., VELCRO®). Securement means used to configure a helmet cap as disclosed on a helmet may secure the cap at any section of the helmet. In an embodiment, and similar to other caps described herein, securement means may attach a cap at a facemask section of helmet. Alternatively, securement means may attach a cap at one or more points near or on the edges of a helmet. Any securement means, whether permanent or temporary, and any location of attachment to a helmet for such means, are contemplated as within the scope of the present disclosure.

In an embodiment, an attachment system may be used that allows helmet cap 1900 to be slidingly displaced upon impact relative to helmet 1950. Any securement means allowing deformation and displacement of helmet cap 1900 is contemplated as within the scope of the present disclosure.

Helmet cap 1900 may also include ear holes 1912. Ear holes 112 may correspond to existing ear holes in existing helmets of any type. Ear holes 112 may allow the wearer of the helmet cap 1900 to hear sounds in the wearer's surroundings while utilizing helmet cap 1900 and may add to the ventilation normally associated with the helmet type. Any type, number, size, and shape of ear holes may be used in helmet cap 1900, while in other embodiments, helmet cap 1900 may not include any ear holes 1912. For example, in situations where the underlying hard shell helmet does not cover the ears, helmet cap 1900 may not have any ear holes 1912. Alternatively, if there is an underlying helmet that covers the ears but does not have earholes, then helmet cap 1900 may not have ear holes 1912.

Figure 20:
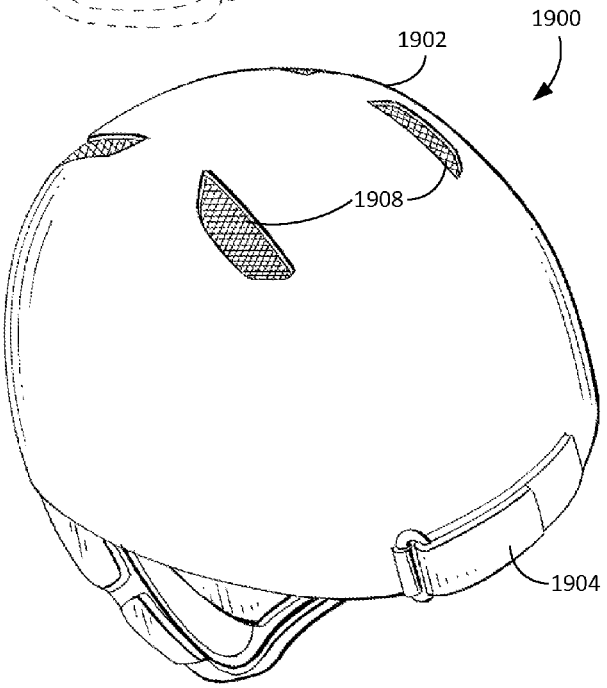
FIG. 20 illustrates a perspective view of an exemplary helmet cap.

FIG. 20 illustrates another view of helmet cap 1900. Shown in FIG. 20 are outer including holes 1908 and second securing strap 1904 that may function to tighten helmet cap 1900 about a perimeter of a helmet, thereby assisting in keep a helmet cap attached to a helmet.

Figure 21:
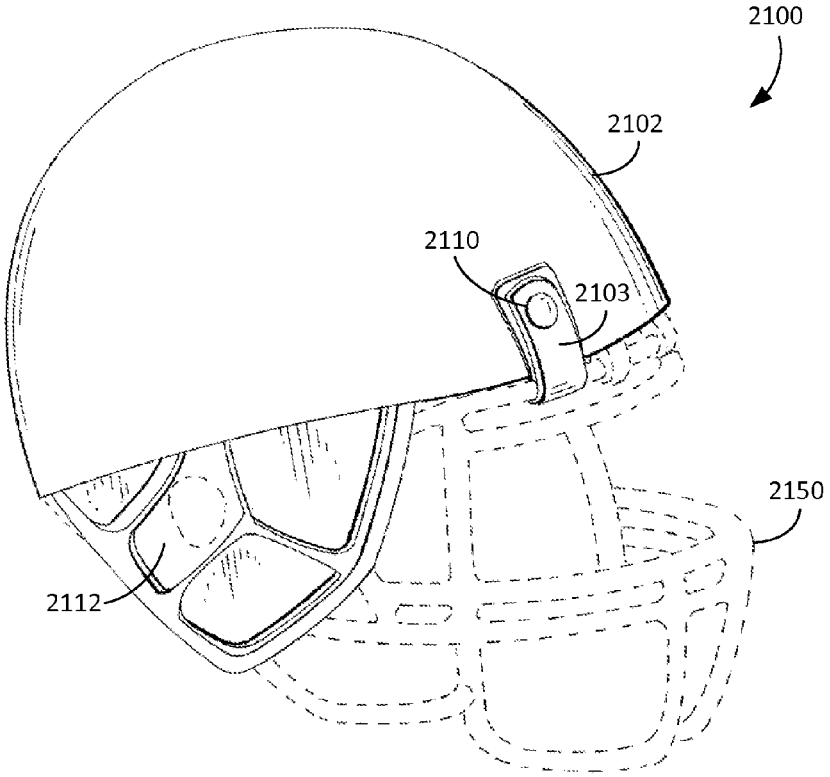
FIG. 21 illustrates a perspective view of an exemplary helmet cap configured on a helmet.
Figure 22:
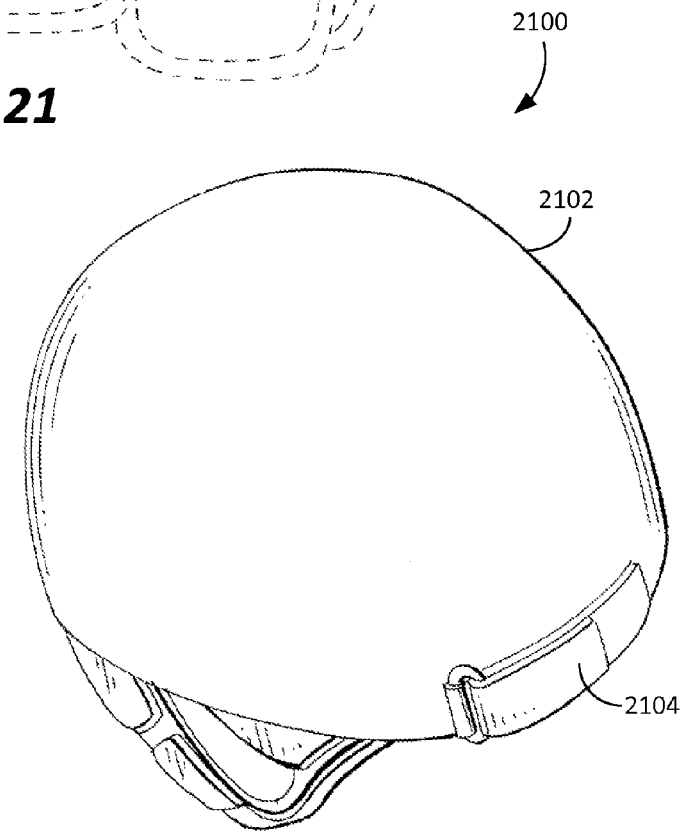
FIG. 22 illustrates a perspective view of an exemplary helmet cap.

In some embodiments, no holes are provided in a helmet cap. FIGS. 21 and 22 illustrate such an embodiment, where helmet cap 2100, having outer shell 2102, may be configured on helmet 2150 and may have securing strap 2103 attached to attachment point 2110, securing strap 2104, and/or earholes 2112. Helmet cap 2100, and any helmet cap described herein, may have any or all of the features of other helmet caps described herein, or none of such features. All such embodiments are contemplated as within the scope of the present disclosure.

A helmet cap as disclosed may provide a lightweight, waterproof exterior design with a low coefficient of friction skin that reduces the force of impacts and may attach to any standard football helmet with ease. By using the disclosed helmet cap, injury to players may be minimized because hard helmet-to-helmet contact may be reduced or eliminated.

While the present embodiments have been described in connection with the various figures, it is to be understood that other similar embodiments may be used or modifications and additions may be made to the described embodiment for performing the same function as the disclosed subject matter without deviating therefrom. All such embodiments are contemplated as within the scope of the present disclosure.

What is claimed is:

1. A helmet cap comprising:

an outer shell comprising a plurality of padded segments disposed such that a majority of the outer shell includes a padded area to facilitate energy absorption upon direct impact with an object, the outer shell further comprising:

a lower section designed to attach to a first portion of an exterior of a helmet, the lower section further designed to cover a periphery of the exterior of the helmet;

an upper section designed to cover a top portion of the exterior of the helmet, wherein one or more padded segments of the plurality of padded segments is designed to be slidingly displaced along the top portion of the exterior of the helmet upon direct impact with an object;

wherein the lower section of the outer shell comprises a strap attachment point designed to facilitate attachment of the lower section to the first portion of the exterior of the helmet;

an elastic strap connected to the attachment point, wherein the elastic strap is designed to attach to the helmet; and wherein the attachment point and the elastic strap are each designed to attach the outer shell to a facemask of the helmet.

2. The helmet cap of claim 1, wherein a gap is interposed in the upper section of the outer shell between a first configuration of padded segments from the plurality of padded segments and a second configuration of padded segments from the plurality of padded segments.

3. The helmet cap of claim 2, wherein one or more of the first configuration of padded segments from the plurality of padded segments and the second configuration of padded segments from the plurality of padded segments is substantially triangle-shaped.

4. The helmet cap of claim 1, wherein at least one padded segment of the plurality of padded segments comprises at least one of polyurethane, rebound foam, closed-cell foam, neoprene foam, and viscoelastic polymer gel.

5. The helmet cap of claim 1, wherein a majority of the padded segments of the plurality of padded segments are designed to each have a height and a width that are each greater than a depth.

6. The helmet cap of claim 1, wherein a portion of the plurality of padded segments are arranged in a first configuration on the upper section and a second configuration on the lower portion, different from the first configuration.

7. A helmet cap comprising:

an outer shell designed to cover a portion of an exterior of a helmet, the outer shell comprising a plurality of padded segments disposed such that a majority of the helmet is covered by a padded area to facilitate energy absorption upon direct impact with an object, the outer shell further comprising:

an inner surface substantially in contact with the portion of the exterior of the helmet;

an attachment point at which the outer shell is attached to the helmet wherein the outer shell is otherwise decoupled from the portion of the exterior of the helmet to facilitate a sliding displacement of the inner surface relative to the portion of the exterior of the helmet upon direct impact of the outer shell with an object; and an elastic strap connected to the attachment point, wherein the elastic strap is designed to attach to the helmet;

wherein the attachment point and the elastic strap are each designed to attach the outer shell to a facemask of the helmet.

8. The helmet cap of claim 7, wherein the inner surface is designed to provide a low coefficient of friction between the inner surface and the portion of the exterior of the helmet.

9. The helmet cap of claim 7, wherein:

a gap is interposed between a first configuration of padded segments from the plurality of padded segments and a second configuration of padded segments from the plurality of padded segments; and one or more of the first configuration of padded segments from the plurality of padded segments and the second configuration of padded segments from the plurality of padded segments is substantially triangle-shaped.

10. The helmet cap of claim 7, wherein a majority of the padded segments of the plurality of padded segments are designed to each have a height and a width that are each greater than a depth.

11. The helmet cap of claim 7, wherein the outer shell defines an ear hole, the ear hole positioned in the outer shell to align with an ear hole of the helmet.

12. A helmet cap comprising:

an outer shell designed to cover a portion of an exterior of a helmet, the outer shell comprising a plurality of padded segments disposed such that a majority of the helmet is covered by a padded area to facilitate energy absorption upon direct impact with an object, the outer shell further comprising:

an inner surface substantially in contact with the exterior of the helmet, wherein at least one padded segment of the plurality of padded segments is designed to stretch in a tangential direction with respect to the exterior of the helmet;

a gap interposed between a first configuration of padded segments from the plurality of padded segments and a second configuration of padded segments from the plurality of padded segments; and a strap attachment point, wherein the outer shell is designed to attach to the helmet via the strap attachment point;

wherein the strap attachment point is designed to attach the outer shell to a facemask of the helmet.

13. The helmet cap of claim 12, wherein:

a second ventilation gap is interposed between a third configuration of padded segments from the plurality of padded segments and a fourth configuration of padded segments from the plurality of padded segments.

14. The helmet cap of claim 12, wherein:

one or more of the first configuration of padded segments from the plurality of padded segments and the second configuration of padded segments from the plurality of padded segments is substantially triangle-shaped.

15. The helmet cap of claim 12, wherein a majority of the padded segments of the plurality of padded segments are designed to each have a height and a width that are each greater than a depth.

* * * * *